US009409371B1

(12) United States Patent
Valenti, Jr. et al.

(10) Patent No.: US 9,409,371 B1
(45) Date of Patent: Aug. 9, 2016

(54) LABEL FOLDING APPARATUS AND METHODS FOR ITS USE

(71) Applicant: Chicago Tag & Label, Inc., Libertyville, IL (US)

(72) Inventors: F. Paul Valenti, Jr., Barrington, IL (US); Carl Opel, Carol Stream, IL (US); Daniel Hedger, Grayslake, IL (US); John Cammarata, Frankfort, IL (US); Mike English, Frankfort, IL (US)

(73) Assignee: Chicago Tag & Label, Inc., Libertyville, IL (US)

( * ) Notice: Subject to any disclaimer, the term of this patent is extended or adjusted under 35 U.S.C. 154(b) by 0 days.

(21) Appl. No.: 15/063,700

(22) Filed: Mar. 8, 2016

Related U.S. Application Data

(63) Continuation-in-part of application No. 14/212,277, filed on Mar. 14, 2014, now Pat. No. 9,302,444.

(51) Int. Cl.
*B31D 1/02* (2006.01)

(52) U.S. Cl.
CPC ..... *B31D 1/022* (2013.01)

(58) Field of Classification Search
CPC ..... B31B 1/12; B31B 1/26; B31B 1/52; B31D 1/02; B31D 1/22
USPC ..... 493/405, 413, 414, 419, 454, 460
See application file for complete search history.

(56) References Cited

U.S. PATENT DOCUMENTS

| | | | |
|---|---|---|---|
| 3,724,341 | A | 4/1973 | Hook |
| 4,091,595 | A | 5/1978 | Pelster et al. |
| 4,102,729 | A | 7/1978 | Annas, Sr. |
| 4,233,798 | A | 11/1980 | Helding |
| 4,270,909 | A | 6/1981 | Ireland |
| 4,272,235 | A | 6/1981 | Barnett |
| 4,290,764 | A | 9/1981 | Middel |
| 4,300,896 | A | 11/1981 | Priebs |
| 4,304,621 | A | 12/1981 | Appoldt et al. |
| 4,347,091 | A | 8/1982 | Hauck et al. |
| 4,367,117 | A | 1/1983 | Seaborn |
| 4,402,679 | A | 9/1983 | Heina |
| 4,432,745 | A | 2/1984 | Eldridge |
| 4,465,453 | A | 8/1984 | Turner et al. |
| 4,470,795 | A | 9/1984 | Prusak |
| 4,475,966 | A | 10/1984 | Turner et al. |
| 4,530,729 | A | 7/1985 | Fuchs et al. |
| 4,617,081 | A | 10/1986 | Bleau et al. |
| 4,627,829 | A | 12/1986 | Brady, Jr. et al. |
| 4,636,192 | A | 1/1987 | Vogtlander et al. |
| 4,678,456 | A | 7/1987 | Nigrelli, Sr. |
| 5,024,644 | A | 6/1991 | Bunch, III |
| 5,826,408 | A | 10/1998 | Ford |
| 6,635,005 | B1 | 10/2003 | Duhamel et al. |
| 7,083,559 | B2 | 8/2006 | Castello et al. |

(Continued)

FOREIGN PATENT DOCUMENTS

| | | | | |
|---|---|---|---|---|
| GB | 912594 | * 12/1962 | ..... | B31D 1/022 |
| WO | WO 2011112215 | * 9/1984 | ..... | B32B 38/14 |

(Continued)

*Primary Examiner* — Gloria R Weeks

(74) *Attorney, Agent, or Firm* — Ice Miller LLP

(57) ABSTRACT

A label folding apparatus and methods for its use are disclosed. Such a label folding apparatus comprises a label folding assembly and a label holding assembly, and may be used to fold a foldable label placed onto the label holding assembly.

24 Claims, 31 Drawing Sheets

(56) References Cited

U.S. PATENT DOCUMENTS

| | | | |
|---|---|---|---|
| 7,708,679 | B2 | 5/2010 | Cailloux et al. |
| 2004/0102301 | A1 | 5/2004 | Szczerba |
| 2007/0049478 | A1 | 3/2007 | Brunow et al. |
| 2011/0294638 | A1 | 12/2011 | Tosevski |

FOREIGN PATENT DOCUMENTS

| | | | | |
|---|---|---|---|---|
| WO | WO 8905727 | * | 6/1989 | B31D 1/022 |
| WO | WO 0166343 | * | 9/2001 | B31D 1/022 |

* cited by examiner

LABEL FOLDING APPARATUS AND METHODS FOR ITS USE

CROSS-REFERENCE TO RELATED APPLICATIONS

This application is a continuation-in-part application of U.S. application Ser. No. 14/212,277, filed on Mar. 14, 2014 and titled LABEL FOLDING APPARATUS AND METHODS FOR ITS USE, which is incorporated by reference in its entirety in the disclosure of this application.

BACKGROUND

Labels are commonly used to secure printed indicia to packages to indicate shipping or other information. In the instance of a shipping use, a separate packing list may be enclosed within a package shipped to the customer containing a purchased item.

There is significant demand for a labeling method that allows automatic printing and application of a lower label and an upper label to a surface. For example, there is significant demand for a labeling method that allows automatic printing and application of a packing list and shipping label to the surface of a sealed carton. Because the carton is sealed prior to packing list generation, it is not efficient to open it to insert a packing list. High volume shipping of such packages requires rapid attachment of a packing list and a shipping label to the package. It is preferred to conceal the information of the packing list until the final recipient receives the shipped package.

Complicated methods have been implemented for application of a lower label and an upper label to a surface. For example, where a packing list and shipping label are to be applied to the surface of a sealed carton, complicated methods have been implemented in which a packing list is applied and adhered atop a carton, using a first roll of labels (packing list labels) and a first label applicator. After the packing list label is applied, an address label is applied and adhered atop the packing list label, to conceal the packing list information, using a second roll of labels (address labels) and a second label applicator. Such methods have many shortcomings. For example, precise timing between the packing list application and the shipping label application is required to properly align the two labels, and to avoid mismatches between the packing list and the shipping label (e.g., where the packing list contains information about goods to be shipped to a first customer and the shipping label contains the address of a different customer. In addition, because two printers and two label applicators, along with related hardware and software, are required to apply a packing list and shipping label in sequence, such methods require significant floor space and investment. For the foregoing reasons, it is desired to provide labeling methods that allows automatic printing and application of a lower label and an upper label to a surface while avoiding the many shortcomings of existing labeling methods.

For the foregoing reasons, it is desired to provide labeling methods that allows automatic printing and application of a packing list label and shipping label to the surface of a sealed carton while avoiding the many shortcomings of existing labeling methods.

SUMMARY

The present disclosure includes disclosure of at least one embodiment of a label folding assembly comprising a label deflector and a label folding device. In a label folding assembly according to at least one embodiment of the present disclosure, a label deflector is mounted to a moveable carriage. In a label folding assembly according to at least one embodiment of the present disclosure, a label deflector comprises an axis, and the axis of the label deflector is not in alignment with a direction of travel of a moveable carriage on which the label deflector is mounted. In a label folding assembly according to at least one embodiment of the present disclosure, a label deflector comprises a curved surface. In a label folding assembly according to at least one embodiment of the present disclosure, a label folding device is mounted to a moveable carriage. In a label folding assembly according to at least one embodiment of the present disclosure, a label folding device comprises a member that extends and retracts.

The present disclosure includes disclosure of at least one embodiment of a label folding apparatus comprising a label folding assembly and a label holding assembly. In a label folding apparatus according to at least one embodiment of the present disclosure, the label folding apparatus comprises a label folding assembly, the label folding assembly comprising a label deflector and a label folding device; and a label holding assembly adjacent the label folding assembly, the label holding assembly comprising a first surface suitable for placing a label thereagainst. In a label folding apparatus according to at least one embodiment of the present disclosure, a label holding assembly comprises at least one aperture through a first surface. In a label folding apparatus according to at least one embodiment of the present disclosure, when a label is placed onto a label holding assembly, the label is held against the label holding assembly by a vacuum force acting through at least one aperture in a first surface of the label holding assembly. In a label folding apparatus according to at least one embodiment of the present disclosure, a first surface of a label holding assembly comprises at least one boundary adjacent a label folding assembly, and when a label is placed onto the label holding assembly, the label extends past the boundary. In a label folding apparatus according to at least one embodiment of the present disclosure, a label deflector is mounted to a moveable carriage. In a label folding apparatus according to at least one embodiment of the present disclosure, a moveable carriage of a label folding assembly is moveable in relation to an adjacent label holding apparatus. In a label folding apparatus according to at least one embodiment of the present disclosure, a moveable carriage of a label folding assembly is moveable between a first position and a second position. In a label folding apparatus according to at least one embodiment of the present disclosure, when a label is placed onto a label holding assembly, movement of a moveable carriage between a first position and a second position causes a label deflector to displace a portion of the label. In a label folding apparatus according to at least one embodiment of the present disclosure, a label folding device is mounted to a moveable carriage. In a label folding apparatus according to at least one embodiment of the present disclosure, when a label is placed onto a label holding assembly, movement of a moveable carriage between a first position and a second position brings a label folding device into alignment with the label. In a label folding apparatus according to at least one embodiment of the present disclosure, a label folding device comprises a member that is moveable between a first configuration and a second configuration. In a label folding apparatus according to at least one embodiment of the present disclosure, when a label is placed onto the label holding assembly, movement of the member between a first configuration and a second configuration folds the label. In a label folding apparatus according to at least one embodiment of the present disclosure, a label holding assembly further comprises a label applicator configured to apply the label to a substrate. In a label folding apparatus according to at least one embodiment of the present disclosure, a label deflector and a label folding device comprise a single mechanism.

The present disclosure includes disclosure of at least one embodiment of a method for folding a foldable label. In at least one embodiment of the present disclosure, a method for folding a foldable label comprising the steps of: placing a foldable label onto a label holding assembly, the label holding assembly comprising a first surface against which the label is held; moving a movable carriage past an end of the label holding assembly, the movable carriage comprising a label deflector and a label folding device, wherein the movement of the movable carriage displaces a portion of the label; aligning the label folding device with the portion of the label that was displaced; and actuating the label folding device, thereby folding the displaced portion of the label.

The present disclosure includes disclosure of at least one embodiment of a label folding apparatus comprising a label holding assembly and a label folding assembly adjacent a label holding assembly. In a label folding apparatus according to at least one embodiment of the present disclosure, a label holding assembly comprises a first surface suitable for placing a label thereagainst, the label comprising a first portion and second portion. In a label folding apparatus according to at least one embodiment of the present disclosure, a label folding assembly comprises a label deflector and a label folding device attached thereto, the label deflector configured to temporarily engage with and then disengage from a second portion of a label, the label folding device configured to fold a second portion of a label onto a first portion of a label by temporarily engaging with and then disengaging from a second portion of a label after the label deflector has disengaged from a second portion of a label. In a label folding apparatus according to at least one embodiment of the present disclosure, a label folding apparatus further comprises a moveable carriage to which a label deflector and a label folding device are attached, the moveable carriage being moveable in relation to a label holding assembly. In a label folding apparatus according to at least one embodiment of the present disclosure, a moveable carriage is moveable along a path between a first position and a second position. In a label folding apparatus according to at least one embodiment of the present disclosure, when a label is placed onto a label holding assembly, movement of a moveable carriage to a second position causes a label deflector to temporarily engage with and then disengage from a second portion of a label. In a label folding apparatus according to at least one embodiment of the present disclosure, when a label is placed onto a label holding assembly, movement of a moveable carriage to a second position causes a label folding device to fold a label by temporarily engaging with and then disengaging from a second portion of a label after a label deflector has disengaged from a second portion of a label. In a label folding apparatus according to at least one embodiment of the present disclosure, a label folding device comprises a block. In a label folding apparatus according to at least one embodiment of the present disclosure, a block is affixed to a mounting instrument, the mounting instrument is affixed to a label folding assembly. In a label folding apparatus according to at least one embodiment of the present disclosure, an axis of a block is not in alignment with an axis of a label folding assembly. In a label folding apparatus according to at least one embodiment of the present disclosure, a moveable carriage is moveable in a perpendicular direction in relation to a label holding assembly. In a label folding apparatus according to at least one embodiment of the present disclosure, a label folding apparatus comprises a moveable carriage configured to intersect the axis of a label holding device and a label deflector configured to temporarily engage with and then disengage from said second portion of said label. In a label folding apparatus according to at least one embodiment of the present disclosure, a label folding apparatus comprises a moveable carriage configured to continue moving after a label deflector has disengaged from a second portion of a label and a label folding device configured to fold a second portion of a label onto a first portion of a label by temporarily engaging with and then disengaging from a second portion of a label. In a label folding apparatus according to at least one embodiment of the present disclosure, a label deflector and a label folding device remain stationary in relation to a moveable carriage. In a label folding apparatus according to at least one embodiment of the present disclosure, a label deflector and a label folding device comprise a single mechanism. In a label folding apparatus according to at least one embodiment of the present disclosure, a second portion of a label extends into a path of travel of a moveable carriage. In a label folding apparatus according to at least one embodiment of the present disclosure, a second portion of a label is in a path, and when a moveable carriage moves along a path, a label deflector is brought into temporary contact with a label and a label folding device folds a label by being brought into temporary contact with a label. In a label folding apparatus according to at least one embodiment of the present disclosure, a label folding apparatus further comprises a moveable carriage to which a label deflector and a label folding device are attached, the moveable carriage being moveable between a first position and a second position, and when a label is placed onto a label holding assembly, movement of a moveable carriage between a first position and a second position causes a label deflector to engage with and then disengage from a second portion of a label and a label folding device to fold a second portion of a label onto a first portion of a label by temporarily engaging with and then disengaging from a second portion of a label after the label deflector has disengaged from a second portion of a label.

The present disclosure includes disclosure of at least one embodiment of a label folding apparatus comprising a label folding assembly and a label holding assembly adjacent said label folding assembly. In a label folding apparatus according to at least one embodiment of the present disclosure, a label folding assembly comprises a moveable carriage with a label folding device attached thereto, the label folding device comprising a block, the block not being in alignment with an axis of the label folding assembly. In a label folding apparatus according to at least one embodiment of the present disclosure, a label holding assembly comprises a first flat surface suitable for placing a label thereagainst, the moveable carriage being moveable in relation to a label holding assembly while the label folding device remains stationary in relation to the moveable carriage. In a label folding apparatus according to at least one embodiment of the present disclosure, when a label is placed onto a label holding assembly, movement of a moveable carriage causes a folding device to fold a label by temporarily engaging with and then disengaging from a second portion of a label. In a label folding apparatus according to at least one embodiment of the present disclosure, a moveable carriage is moveable in a perpendicular direction in relation to a label holding assembly. In a label folding apparatus according to at least one embodiment of the present disclosure, a label folding apparatus comprises a moveable carriage configured to intersect the axis of a label holding device. In a label folding apparatus according to at least one embodiment of the present disclosure, a label folding apparatus comprises a label folding device configured to fold a second portion of a label onto a first portion of a label by temporarily engaging with and then disengaging from a second portion of a label. In a label folding apparatus according to at least one embodiment of the present disclosure, a label holding assembly further comprises at least one aperture through a first surface. In a label folding apparatus according to at least one embodiment of the present disclosure, when a label is placed onto a label holding assembly, a label is held against a label holding assembly by a vacuum force acting through an at least one aperture. In a label folding apparatus according to at least one embodiment of the present disclosure, a first surface comprises at least one boundary adjacent a label folding assembly, and when a label is placed onto a label holding assembly, a second portion of a label extends past the boundary.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein:

FIG. 29 shows a front view of a label folding apparatus according to at least one embodiment of the present disclosure.

DESCRIPTION

Figure 1:
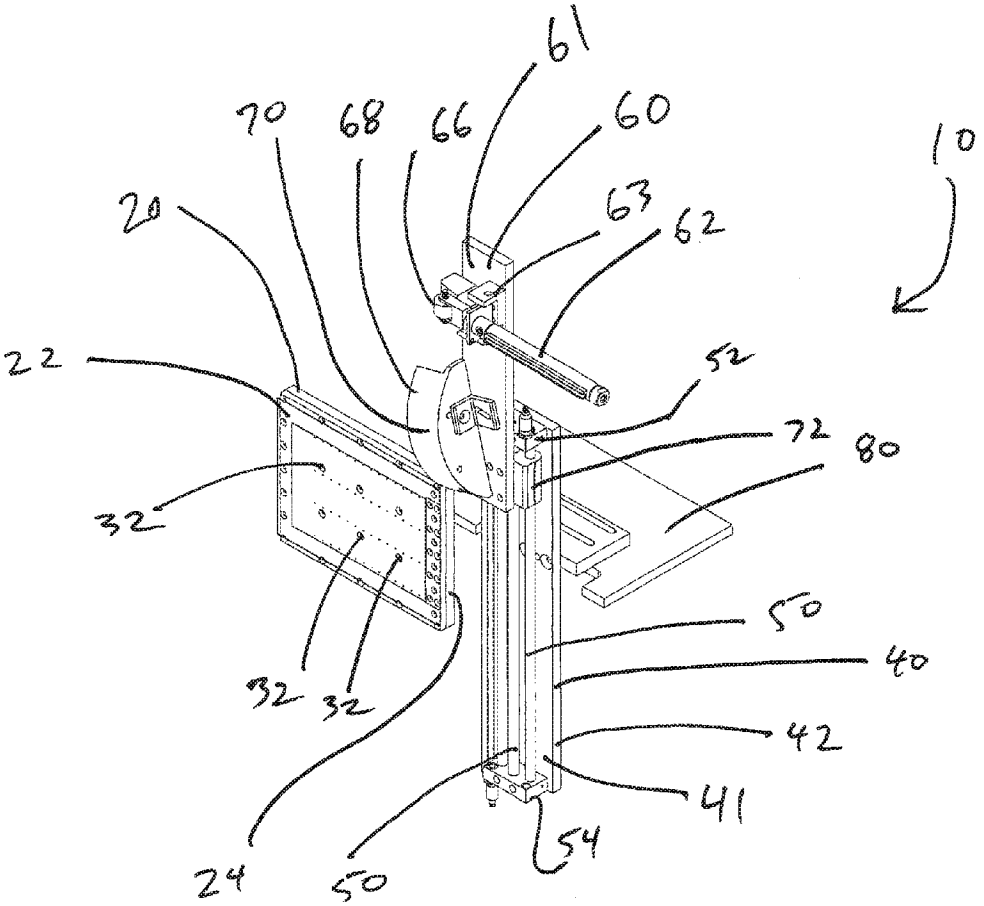
FIG. 1 shows a perspective view of a label folding apparatus according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 2:
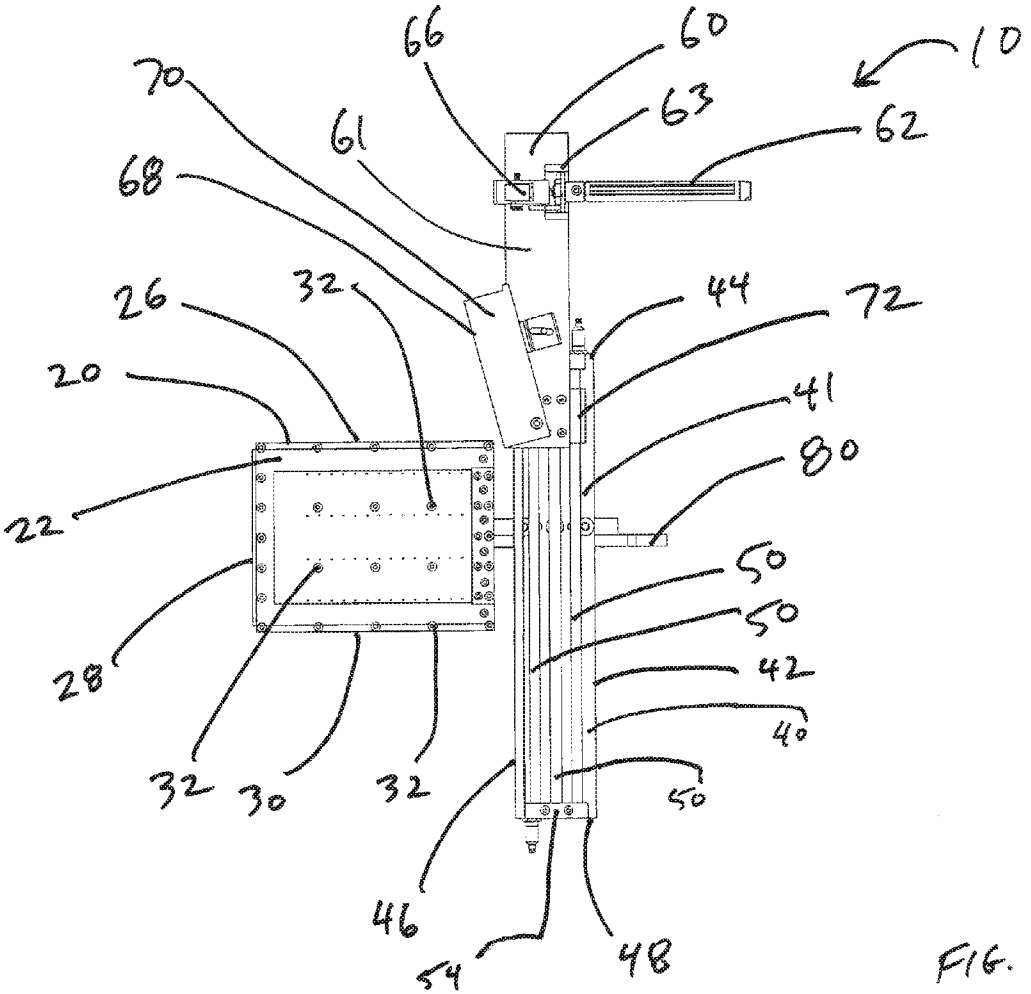
FIG. 2 shows a front view of a label folding apparatus according to at least one embodiment of the present disclosure.
Figure 3:
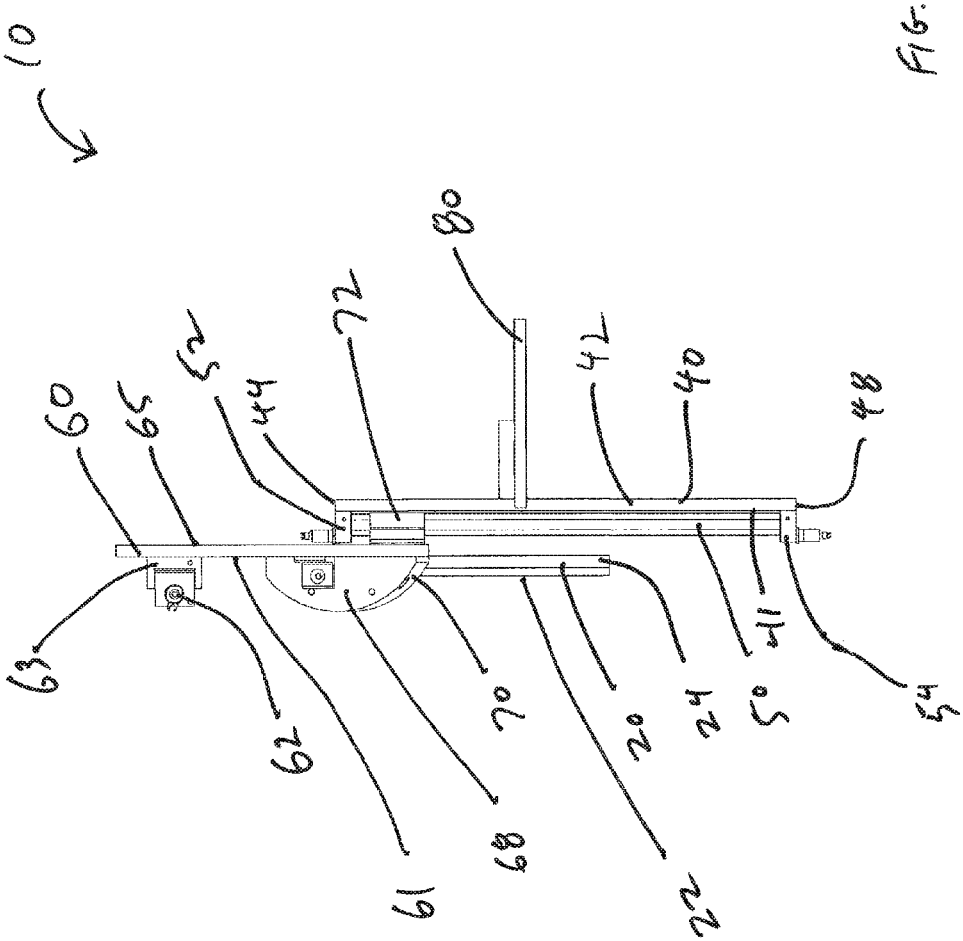
FIG. 3 shows an end view of a label folding apparatus according to at least one embodiment of the present disclosure.

FIG. 1 shows a perspective view of label folding apparatus 10 according to at least one embodiment of the present disclosure. FIG. 2 shows a front view of label folding apparatus 10 according to at least one embodiment of the present disclosure. FIG. 3 shows an end view of label folding apparatus 10 according to at least one embodiment of the present disclosure.

In the embodiment shown in FIGS. 1-3, label folding apparatus 10 comprises label pad assembly 20, slide support assembly 40, slide assembly 60, and label folding apparatus mounting fixture 80.

In the embodiment shown in FIGS. 1-3, label pad assembly 20 comprises label pad surface 22, first end 24, second end 26, third end 28, and fourth end 30. Label pad assembly 20 further comprises at least one aperture 32 that extends through label pad surface 22. Although label pad assembly 20 is shown in FIGS. 1-3 as a rectangular piece, in other embodiments of label folding apparatus 10 label pad 20 may take on other shapes.

In the embodiment shown in FIGS. 1-3, slide support assembly 40 comprises first surface 41, first side 42, second side 44, third side 46, and fourth side 48. First guide rail mount 52 and second guide rail mount 54 are fastened to first surface 41 of slide mount assembly 40. In the embodiment shown in FIGS. 1-3, first guide rail mount 52 is fastened to first surface 41 near second side 44, and second guide rail mount 54 is fastened to first surface 41 near fourth side 48. At least one guide rail 50 extends between first guide rail mount 52 and second guide rail mount 54. In the embodiment of slide support assembly 40 shown in FIGS. 1-3, three guide rails 50 are deployed. However, in other embodiments of label folding apparatus 10 according to the present disclosure, a greater or lesser number of guide rails 50 may be deployed. In the embodiment shown in FIGS. 1-3, and particularly in FIG. 3, there is a gap between guide rails 50 and first surface 41. However, in other embodiments of label folding apparatus 10 according to the present disclosure, guide rails 50 may be in contact with first surface 41.

In the embodiment shown in FIGS. 1-3, slide assembly 60 comprises first surface 61 and opposing second surface 65. Sheath 62 is affixed to mounting piece 63, which in turn is affixed to first surface 61. Guide 72 is affixed to second surface 65 of slide assembly 60. Guide 72 is slidingly coupled to at least one guide rail 50. Sheath 62 encloses member 64 (not shown in FIGS. 1-3). Roller 66 is affixed to end of member 64. Label deflector 68 is affixed to first surface 61 of slide assembly 63. Label deflector 68 comprises label deflector surface 70, which in the embodiment shown in FIGS. 1-3 is a curved surface. Although label deflector 68 is shown in FIGS. 1-3 with a curved label deflector surface 70, other configurations of label deflector surface 70 are possible and within the scope of the present disclosure. In the embodiment shown in FIGS. 1-3, label deflector 68 is affixed to first surface 61 of slide assembly 60 such that an axis of label deflector 68 is not in alignment with an axis of guide rails 50. Other configurations of label deflector 68 are possible and within the scope of the present disclosure.

Label folding apparatus mounting fixture 80 comprises a structure to which label pad assembly 20 and slide support assembly 40 are mounted.

Figure 4:
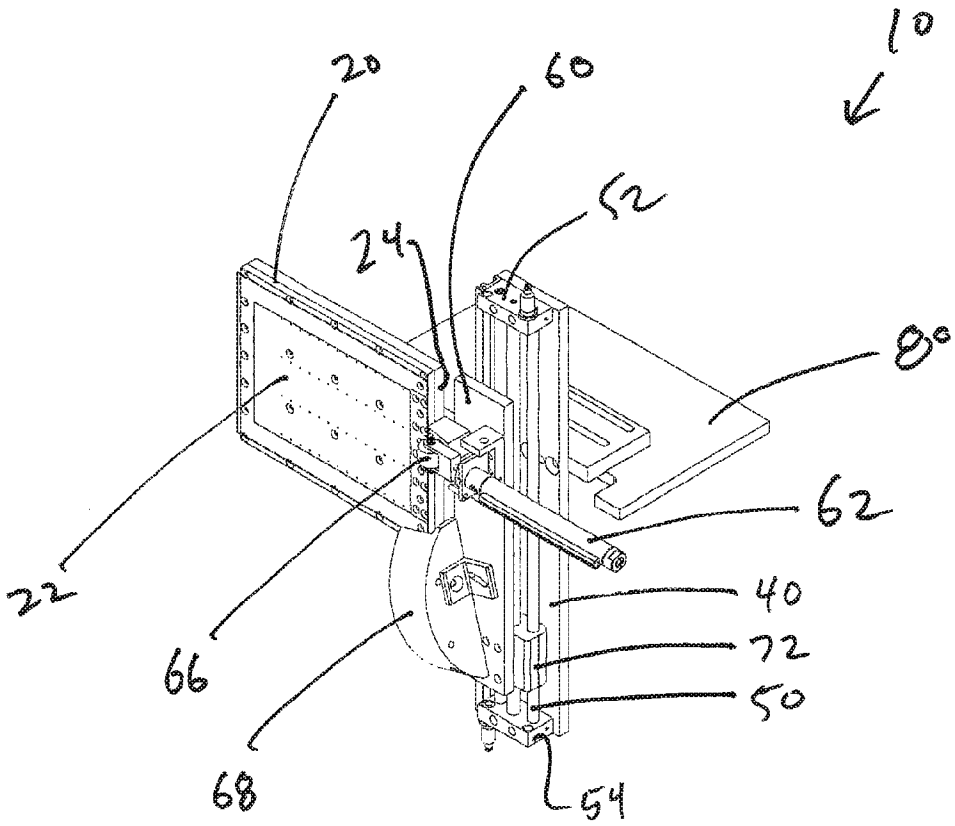
FIG. 4 shows a perspective view of a label folding apparatus according to at least one embodiment of the present disclosure.
Figure 5:
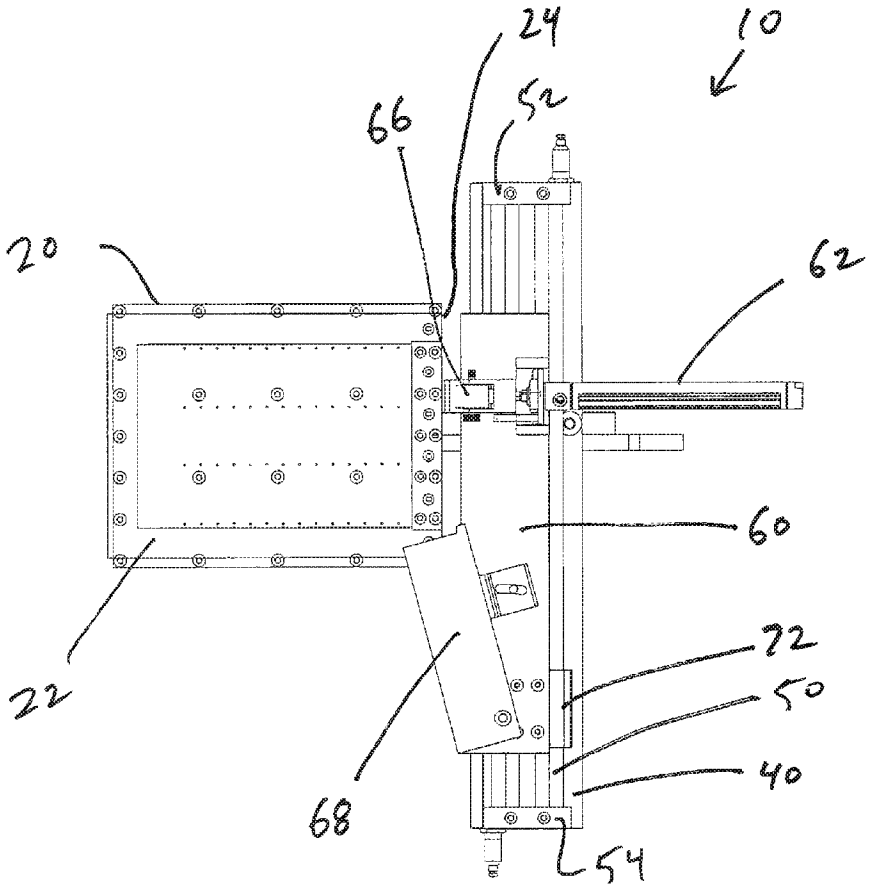
FIG. 5 shows a front view of a label folding apparatus according to at least one embodiment of the present disclosure.
Figure 6:
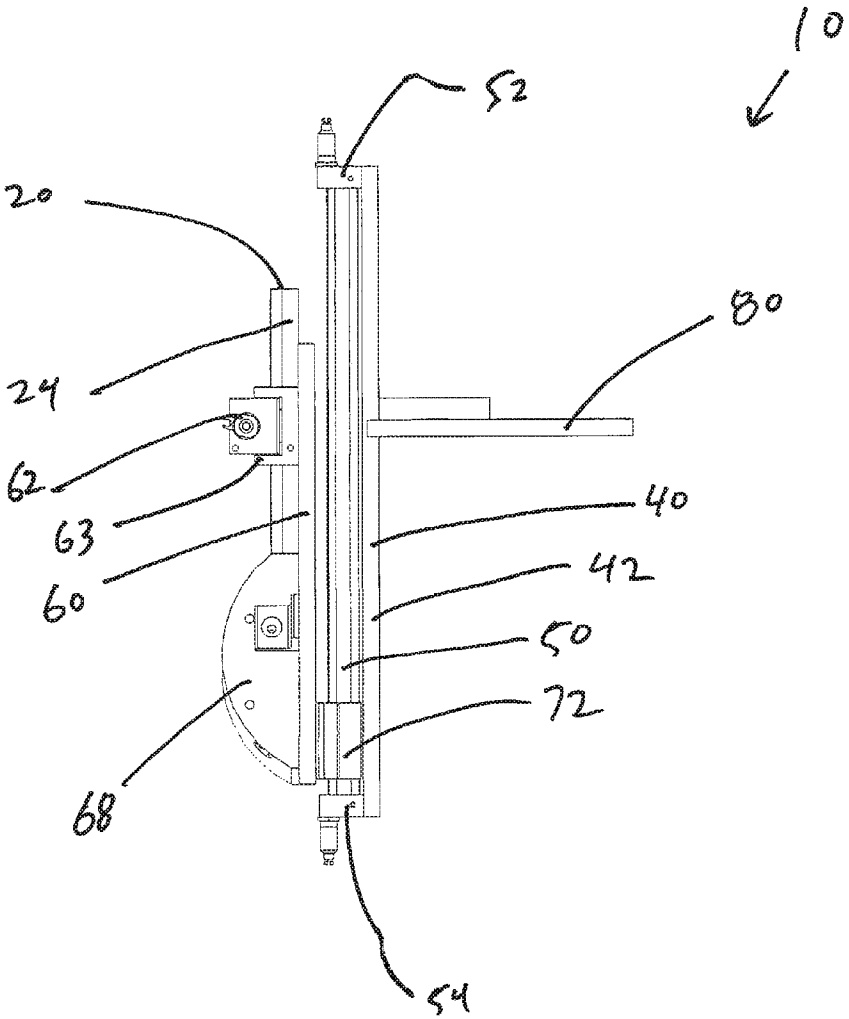
FIG. 6 shows an end view of a label folding apparatus according to at least one embodiment of the present disclosure.

FIGS. 1-3 show label folding apparatus 10 with slide assembly 60 in a first position. In the embodiment shown in FIGS. 1-3, guide 72 of slide assembly 60 is positioned closer to first guide rail mount 52. FIGS. 4-6 show label folding apparatus 10 with slide assembly 60 in a second position. In the embodiment shown in FIGS. 4-6, guide 72 is closer to second guide rail mount 54. FIG. 4 shows a perspective view of label folding apparatus 10 according to at least one embodiment of the present disclosure with slide assembly 60 in the second position. FIG. 5 shows a front view of label folding apparatus 10 according to at least one embodiment of the present disclosure with slide assembly 60 in the second position. FIG. 6 shows an end view of label folding apparatus 10 according to at least one embodiment of the present disclosure with slide assembly 60 in the second position. As slide assembly 60 travels along guide rail 50 between the first position shown in FIGS. 1-3 and the second position shown in FIGS. 4-6, label deflector 68 passes by and/or over first end 24 of label pad assembly 22. When slide assembly 60 is in the second position shown in FIGS. 4-6, roller 66 is aligned with label pad assembly 20. The movement of slide assembly 60 along guide rails 50 may be accomplished by any means that may occur to one skilled in the art after being presented with the disclosure herein, including pneumatic means and electromechanical means.

Figure 7:
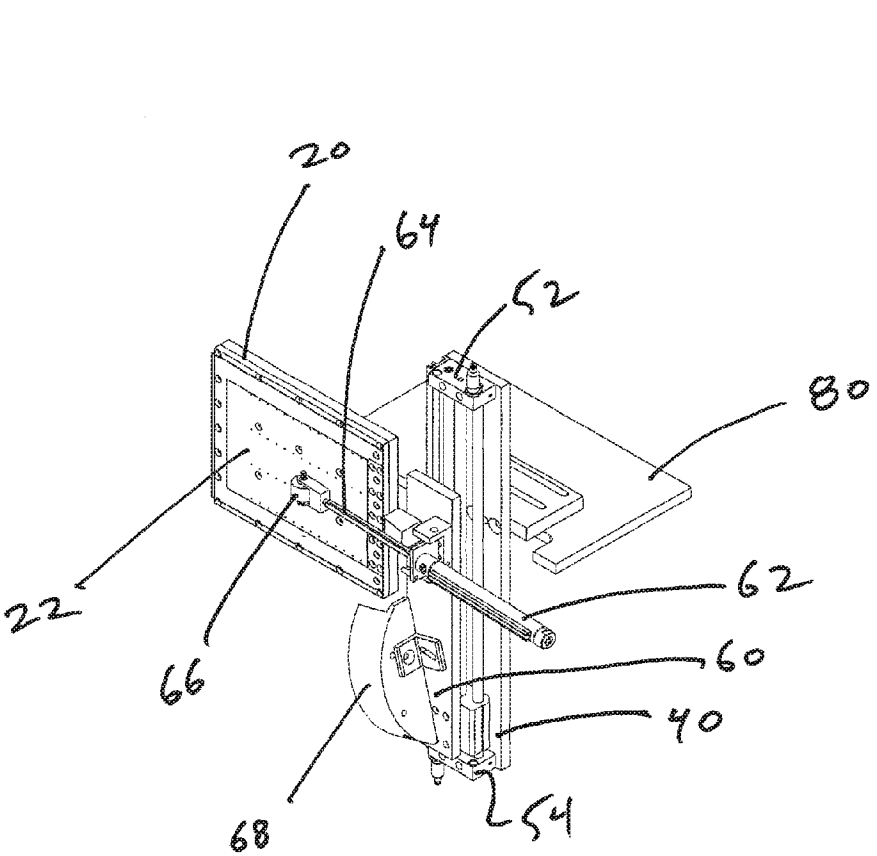
FIG. 7 shows a perspective view of a label folding apparatus according to at least one embodiment of the present disclosure.
Figure 8:
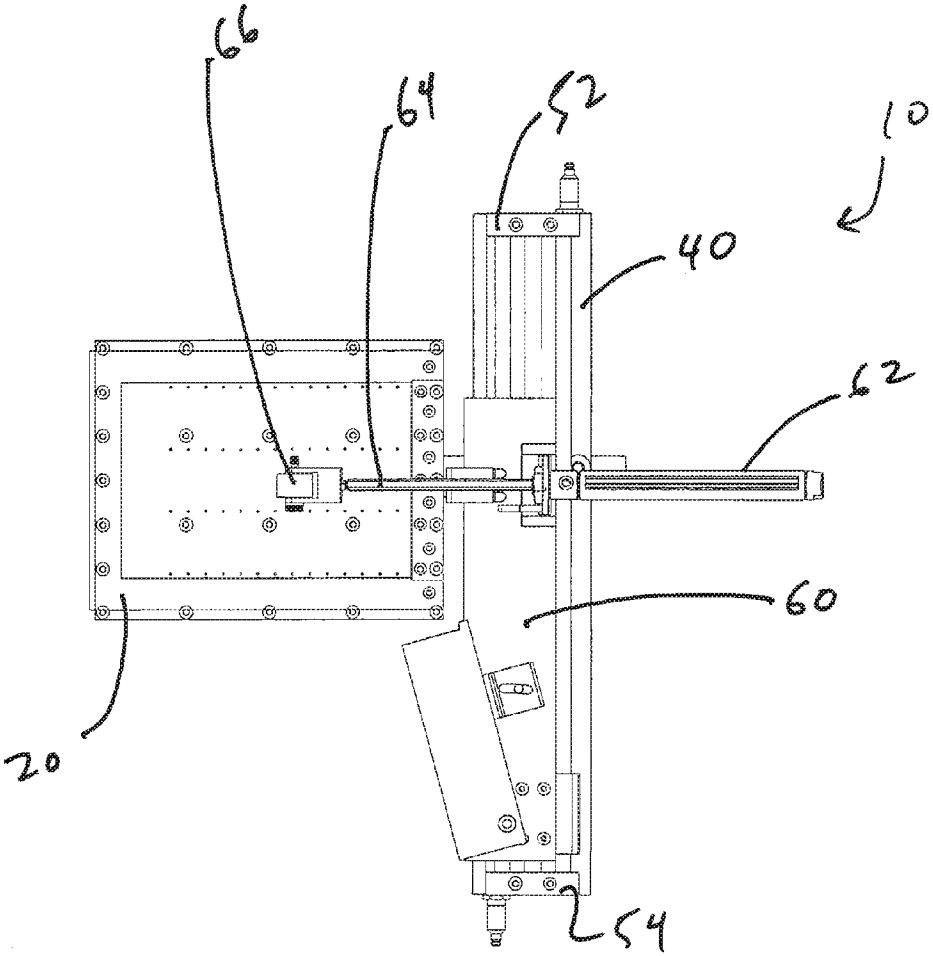
FIG. 8 shows a front view of a label folding apparatus according to at least one embodiment of the present disclosure.

FIG. 7 shows a perspective view of label folding apparatus 10 according to at least one embodiment of the present disclosure, with slide assembly 60 in a second position and member 64 extended from sheath 62. FIG. 8 shows a front view of label folding apparatus 10 according to at least one embodiment of the present disclosure, with slide assembly 60 in a second position and member 64 extended from sheath 62. In the embodiment shown in FIGS. 7-8, when member 64 is extended from sheath 62, roller 66 engages with label pad surface 22. In at least one embodiment of label folding apparatus 10, roller 66 is in contact with label pad surface 22 when member 64 is extended from sheath 62. In at least one embodiment of label folding apparatus 10, roller 66 is not in contact with label pad surface 22 when member 64 is extended from sheath 62. The movement of member 64 may be accomplished by any means that may occur to one skilled in the art after being presented with the disclosure herein, including pneumatic means and electromechanical means.

Figure 9:
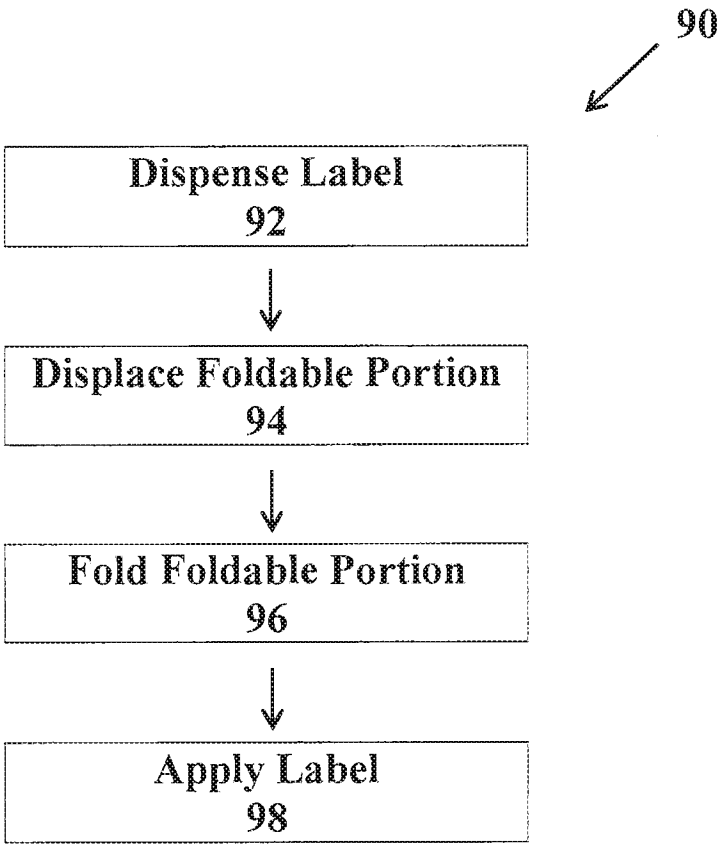
FIG. 9 shows a flowchart illustrating the use of label folding apparatus according to at least one embodiment of the present disclosure.

FIG. 9 shows a flowchart illustrating the operation of a label folding apparatus according to at least one embodiment of the present disclosure. As shown in step 92 of FIG. 9, an at least partially adhesive-backed label is dispensed onto a label folding apparatus. For example, a label assembly comprising release coated liner with one or more at least partially adhesive-backed labels removably adhered thereto may be routed through a dispensing mechanism (not shown) causing an at least partially adhesive-backed label to be separated from the release coated liner and dispensed onto a label folding apparatus with the adhesive exposed. In at least one embodiment, such an at least partially adhesive-backed label comprises a covering portion and a foldable portion. In at least one such embodiment, the covering portion comprises a surface area larger than the surface area of the foldable portion. In step 94 of FIG. 9, the foldable portion of the at least partially adhesive-backed label is displaced by the label folding apparatus. In at least one embodiment of the present disclosure, a label folding apparatus comprises a label deflector on a moveable carriage. In such an embodiment, when moved past the at least partially adhesive-backed label, the label deflector on the moveable carriage displaces at least a portion of the at least partially adhesive-backed label. In at least one embodiment of the present disclosure, the label folding apparatus comprises a stationary label deflector. In such an embodiment, the step of dispensing an at least partially adhesive-backed label onto a label folding apparatus forces the label against or over the stationary label deflector, thereby displacing at least a portion of the at least partially adhesive-backed label. In at least one embodiment of the present disclosure, the label folding apparatus comprises a forced-air label deflector. In such an embodiment, after an at least partially adhesive-backed label is dispensed onto a label folding apparatus, air is blown against the at least partially adhesive-backed label, thereby displacing at least a portion of the at least partially adhesive-backed label. In step 96 of FIG. 9, the foldable portion of the at least partially adhesive-backed label is folded, so that the adhesive of the foldable portion is brought into contact with the adhesive of the covering portion. In step 98 of FIG. 9, the label is applied to a substrate, such as a container or package.

Figure 10:
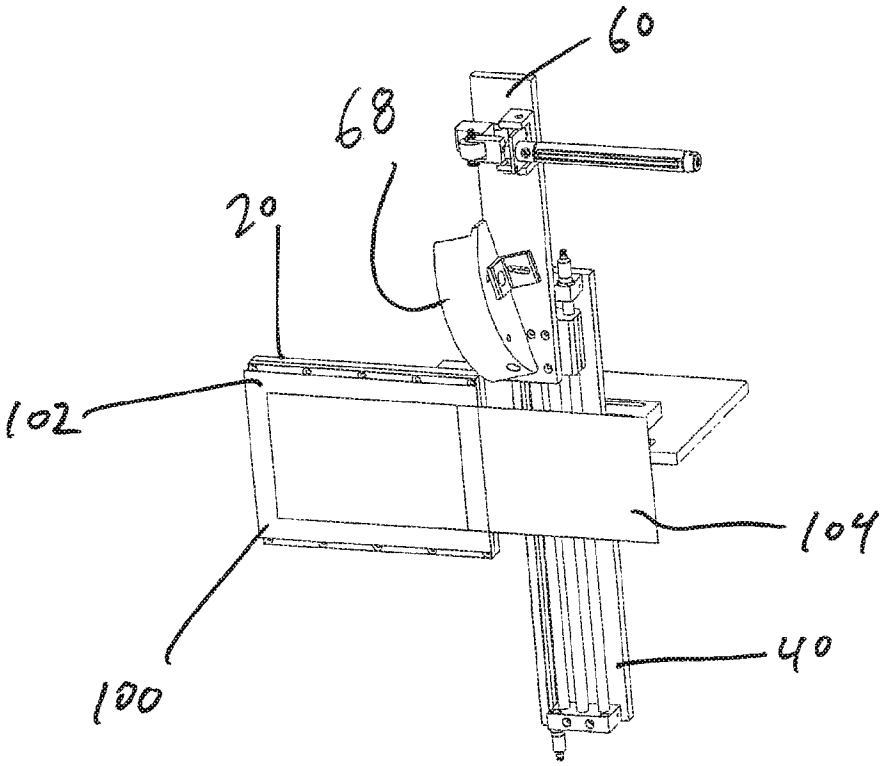
FIG. 10 shows a perspective view of a label folding apparatus according to at least one embodiment of the present disclosure.
Figure 11:
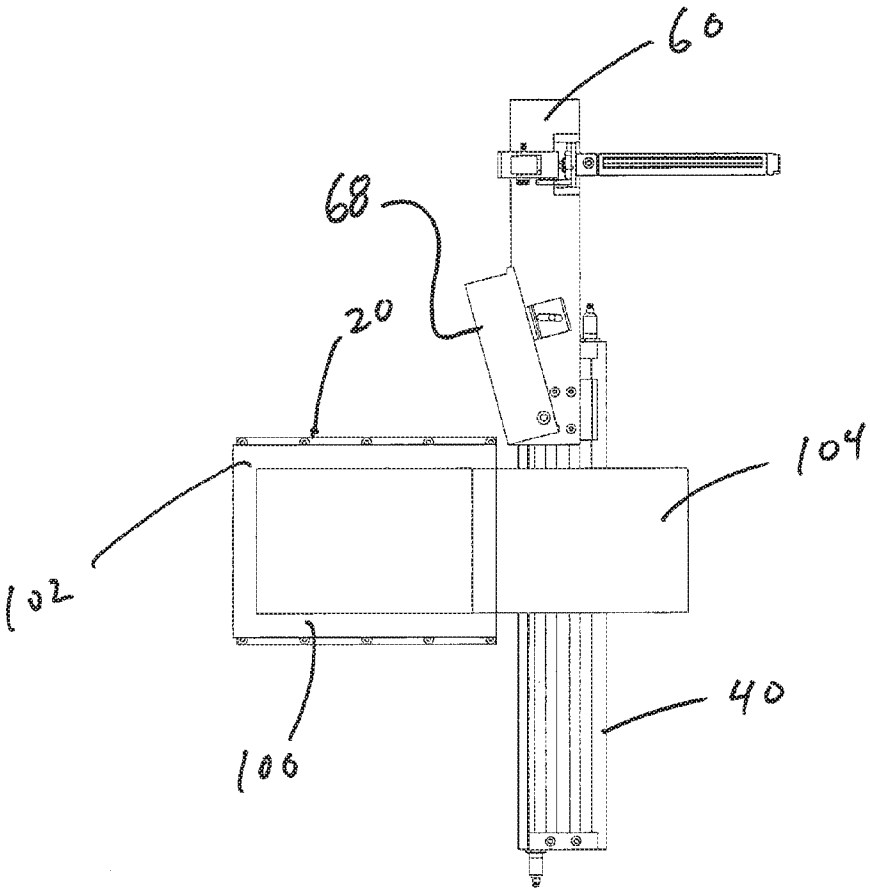
FIG. 11 shows a front view of a label folding apparatus according to at least one embodiment of the present disclosure.

FIGS. 10-11 shows a perspective view of label folding apparatus 10 according to at least one embodiment of the present disclosure with label 100 dispensed thereon. In the embodiment shown in FIGS. 10-11, slide assembly 60 is in the first position as shown in FIGS. 1-3. In the embodiment shown in FIGS. 10-11, label 100 comprises covering portion 102 and foldable portion 104. In at least one such embodiment, covering portion 102 comprises a surface area larger than the surface area of foldable portion 104. As shown in FIGS. 10-11, at least a portion of covering portion 102 and foldable portion 104 comprise an adhesive backing. Label 100 is dispensed onto label pad assembly 20 so that the adhesive backing of covering portion 102 and foldable portion 104 faces away from label pad surface 22. In the embodiment shown in FIGS. 10-11, label 100 is larger than label pad surface 22, so at least a portion of foldable portion 104 extends beyond first end 24 and into the path of label deflector 68. Covering portion 102 is held against label pad surface 22 by a vacuum engaged against covering portion 102 through apertures 32.

Figure 12:
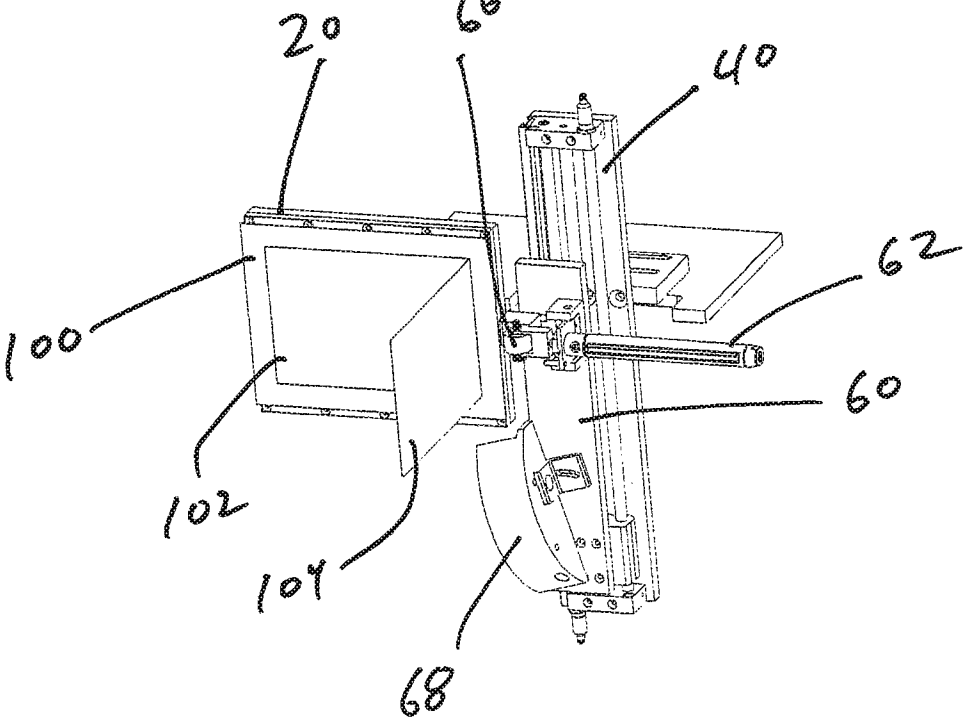
FIG. 12 shows a perspective view of a label folding apparatus according to at least one embodiment of the present disclosure.

FIG. 12 shows label folding apparatus 10 with label 100 dispensed thereon. In the embodiment shown in FIG. 12, slide assembly 60 has traveled from the first position shown in FIGS. 1-3 to the second position shown in FIGS. 4-6. When slide assembly 60 travels from the first position to the second position, label deflector 68 engages foldable portion 104 of label 100, thereby displacing foldable portion 104 of label 100 from its planar alignment with covering portion 102 of label 100. In an embodiment of the present disclosure where label deflector 68 comprises a curved label deflector surface such as curved label deflector surface 70, label deflector 68 progressively engages foldable portion 104 of label 100 as slide assembly 60 travels from the first position to the second position, thereby reducing the risk that label 100 will be torn as label deflector 68 engages foldable portion 104 of label 100. In an embodiment of the present disclosure where label deflector 68 is affixed to first surface 61 of slide assembly 60 at an angle to an axis of guide rails 50, label deflector 68 progressively engages foldable portion 104 of label 100 as slide assembly 60 travels from the first position to the second position, thereby reducing the risk that label 100 will be torn as label deflector 68 engages foldable portion 104 of label 100. In at least one embodiment of label 100, there may be one or more lines of weakness between covering portion 102 and foldable portion 104 so that displacement of foldable portion 104 by label deflector 68 is facilitated.

Figure 13:
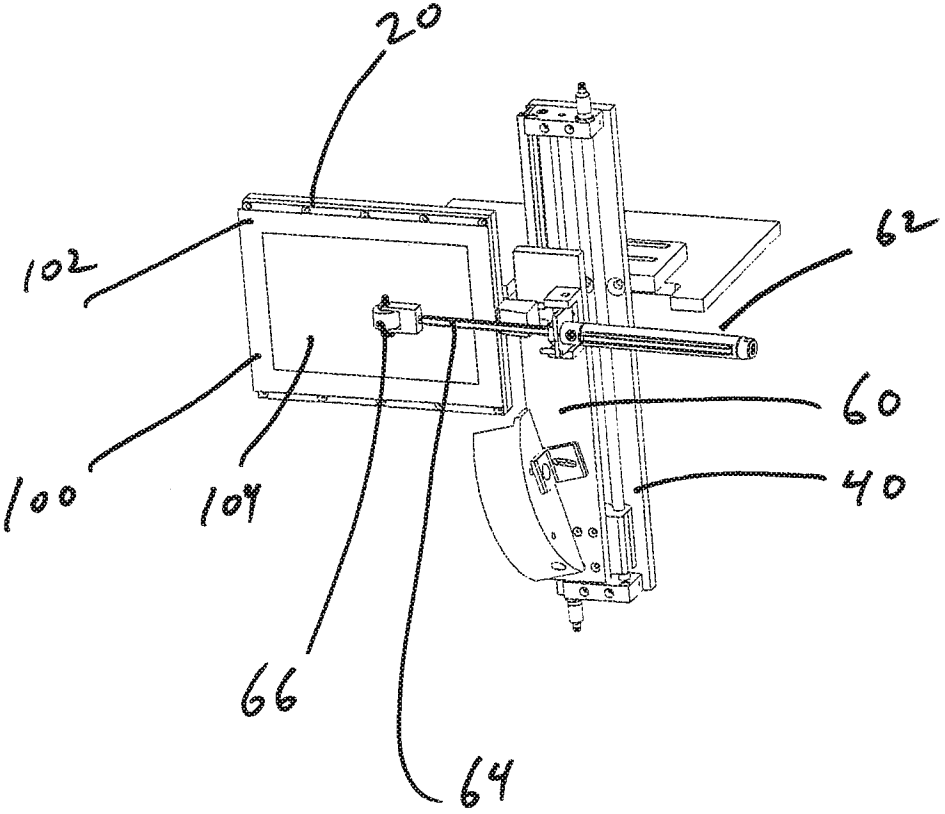
FIG. 13 shows a perspective view of a label folding apparatus according to at least one embodiment of the present disclosure.
Figure 14:
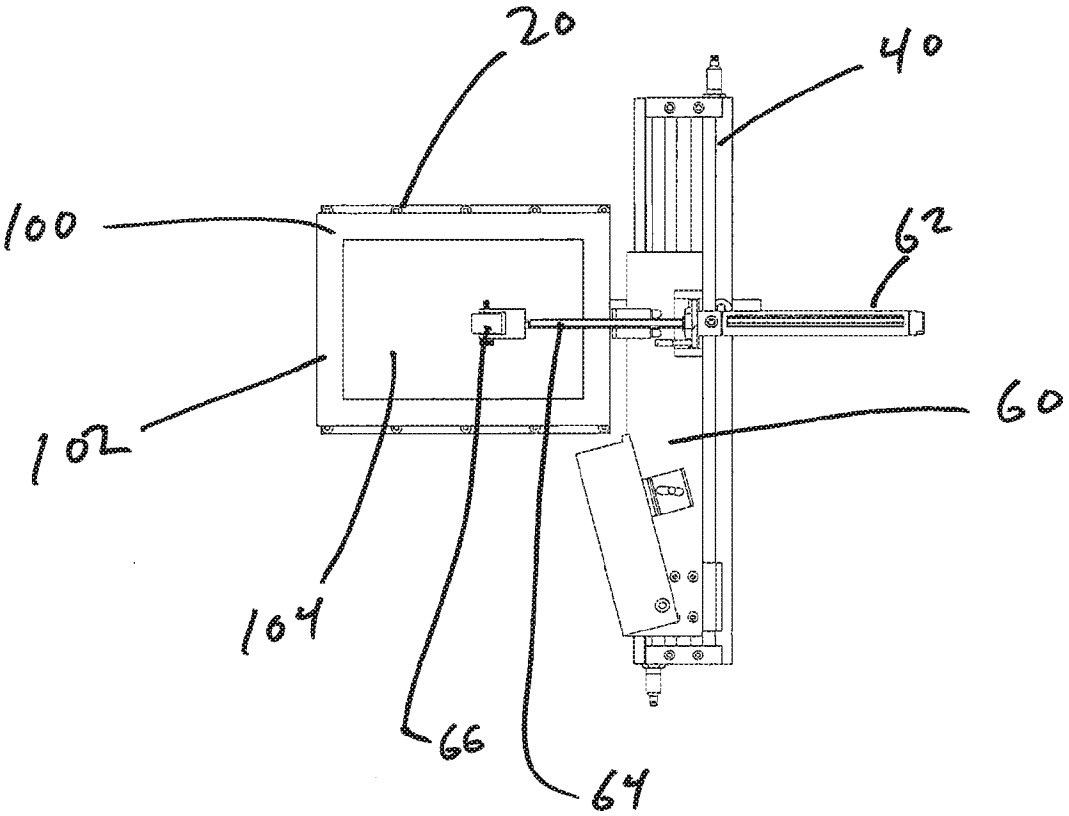
FIG. 14 shows a front view of a label folding apparatus according to at least one embodiment of the present disclosure.

FIGS. 13-14 show label folding apparatus 10 with label 100 dispensed thereon according to at least one embodiment of the present disclosure. In the embodiment shown in FIGS. 13-14, member 64 is extended from sheath 62. Roller 66 thereby contacts foldable portion 104 of label 100, folding foldable portion 104 on label 100 against covering portion 102 of label 100. The adhesive backing on a least a part of covering portion 102 of label 100 and/or foldable portion 104 of label 100 causes foldable portion 104 to be adhered against covering portion 102. In at least one embodiment of the present disclosure, a label folding device (such as, for example, a sheath, member, and roller device like sheath 62, member 64, and roller 66) is not affixed to a moveable carriage such as, for example, slide assembly 60. In such an embodiment, such a label folding device is in a fixed position in alignment with label pad assembly 20. In this fixed position, such a label folding device is aligned with the eventual position of a label that is dispensed onto label pad assembly 20. After a label is dispensed onto such a label pad assembly and portion of such a label has been displaced by a label deflector, such a label folding device then is actuated, thereby folding the label.

Figure 15:
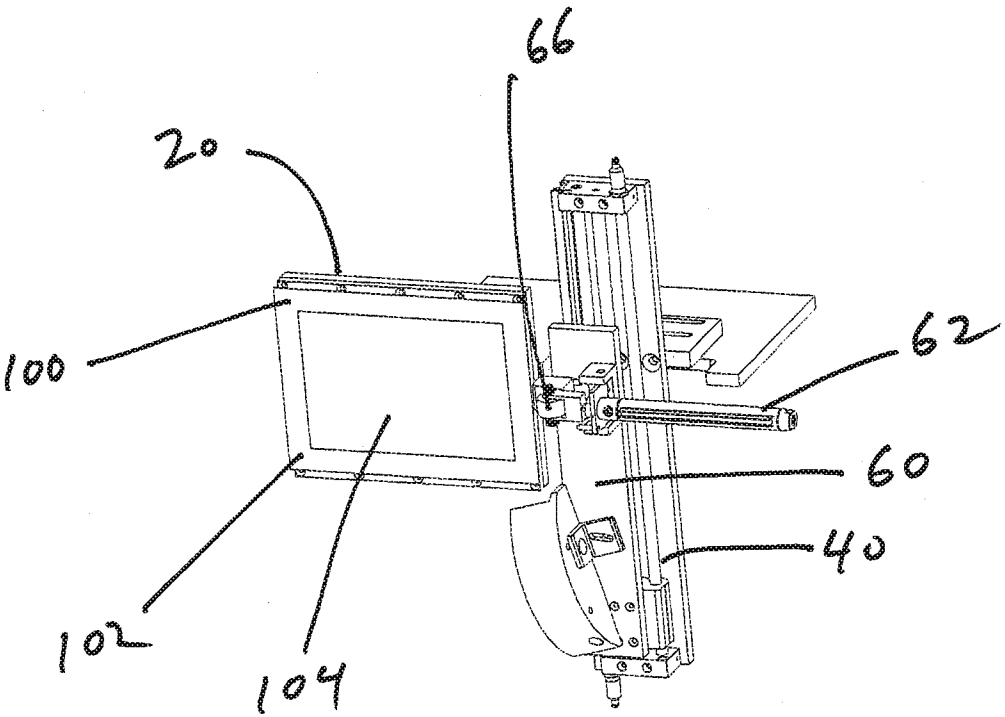
FIG. 15 shows a perspective view of a label folding apparatus according to at least one embodiment of the present disclosure.
Figure 16:
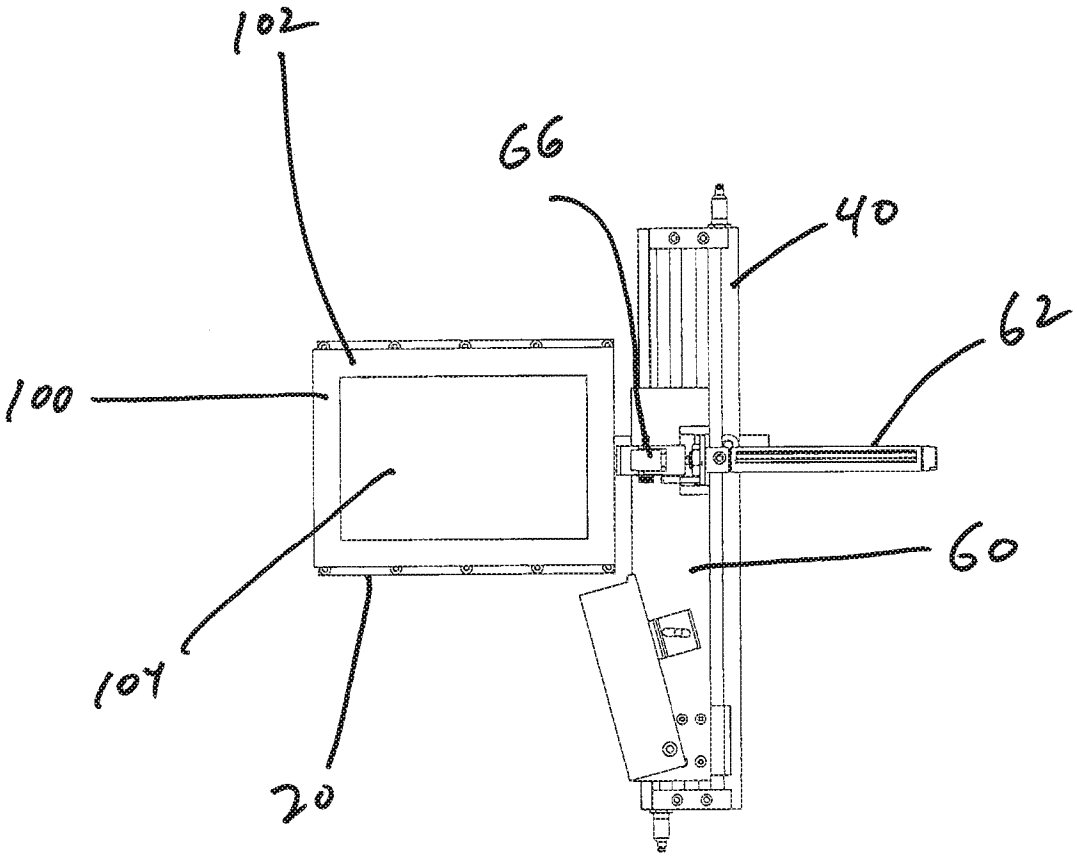
FIG. 16 shows a front view of a label folding apparatus according to at least one embodiment of the present disclosure.

FIGS. 15-16 show label folding apparatus 10 according to at least one embodiment of the present disclosure with label 100 dispensed thereon. In the embodiment shown in FIGS. 15-16, member 64 is retracted into sheath 62, and roller 66 is brought out of engagement with foldable portion 104.

Figure 17:
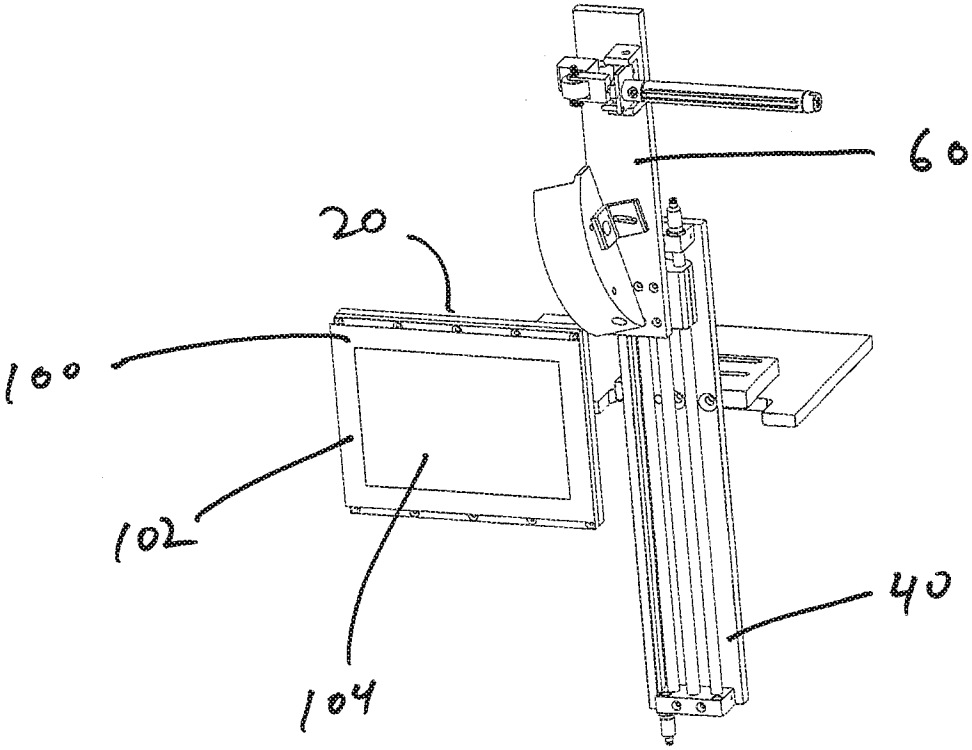
FIG. 17 shows a perspective view of a label folding apparatus according to at least one embodiment of the present disclosure.
Figure 18:
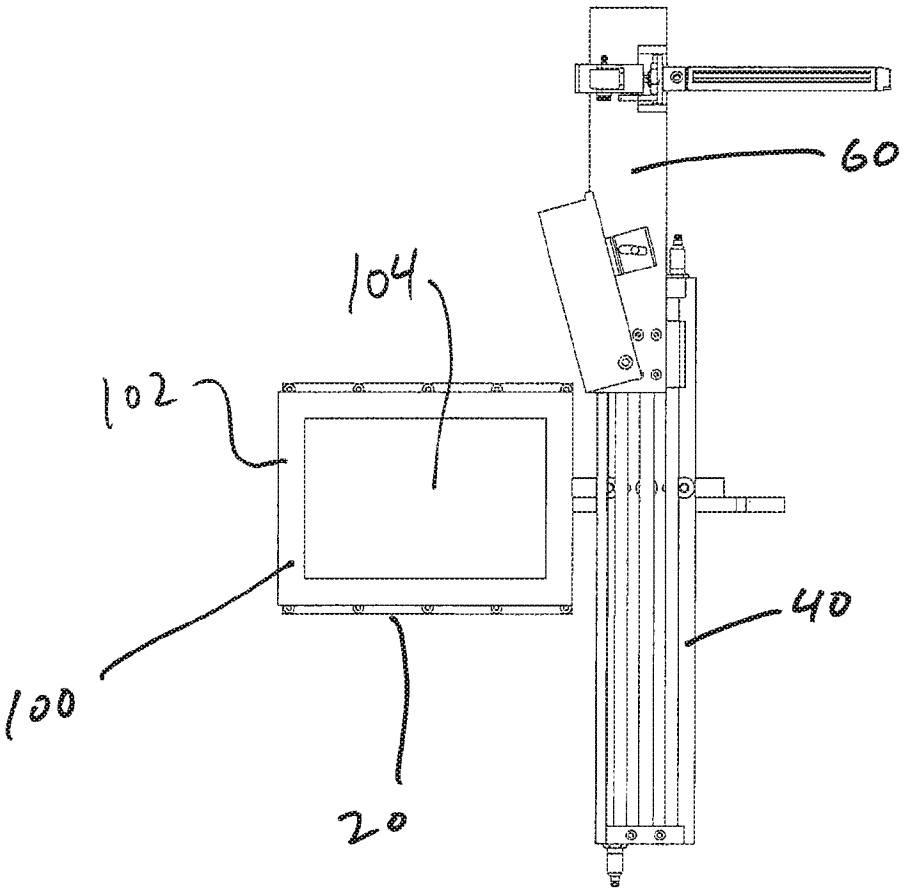
FIG. 18 shows a front view of a label folding apparatus according to at least one embodiment of the present disclosure.

FIGS. 17-18 show label folding apparatus 10 according to at least one embodiment of the present disclosure with label 100 dispensed thereon. In the embodiment shown in FIGS. 17-18, slide assembly 60 is returned to the first position shown in FIGS. 1-3. Label 100 then may be applied to a substrate, such as the surface of a container or the surface of a package. In at least one embodiment, label 100 may be removed from label pad surface 202 manually and manually applied to such a surface. In at least one embodiment, label pad assembly 20 comprises a label applicator mechanism. In such an embodiment, label pad assembly 20 with label 100 attached thereto may be moved into alignment with such a surface so that the exposed adhesive on label 100 will be brought into contact with such a surface.

FIGS. 19-31 illustrate label folding apparatus 110 in accordance with several different embodiments of the present disclosure. It should be noted that the label folding apparatus described in FIGS. 19-31 may be utilized with any of the embodiments described in FIGS. 1-18 and the foregoing description.

Figure 19:
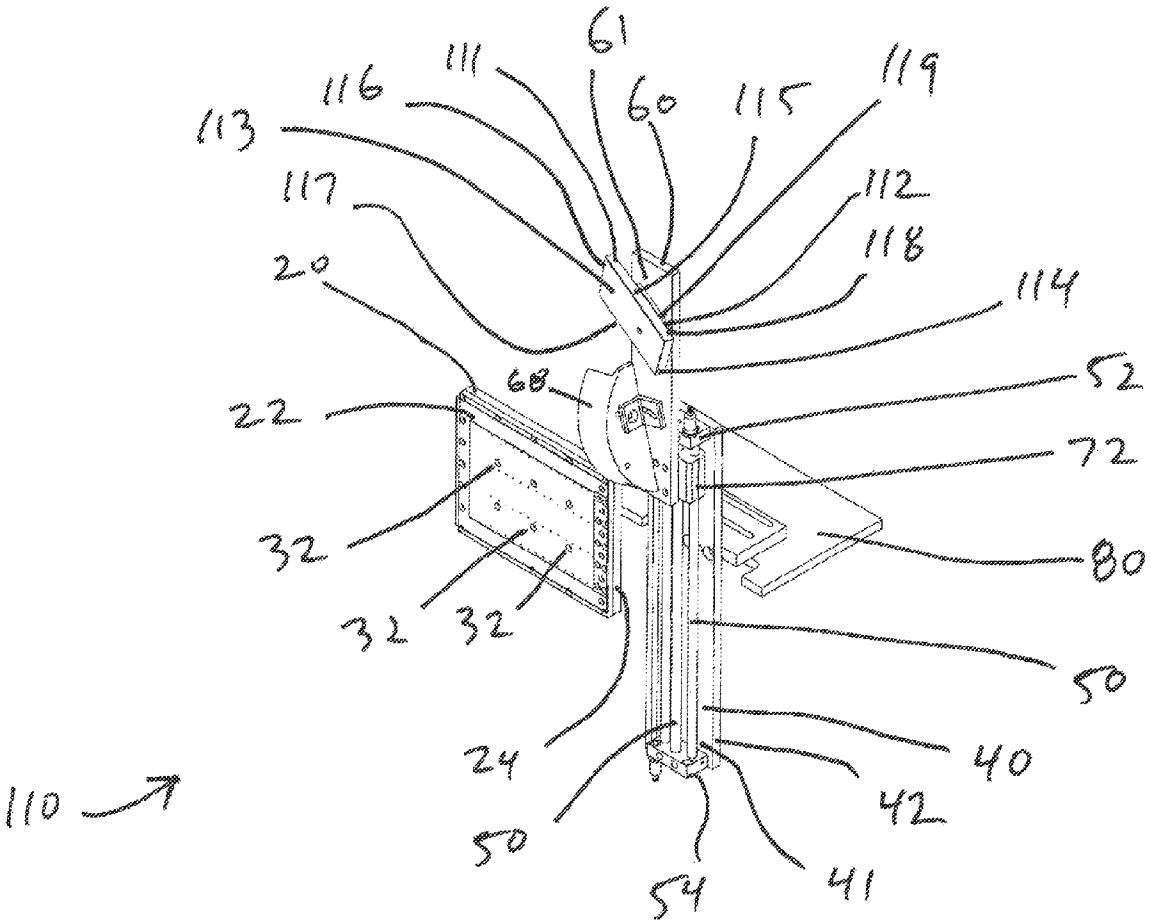
FIG. 19 shows a perspective view of a label folding apparatus according to at least one embodiment of the present disclosure.
Figure 20:
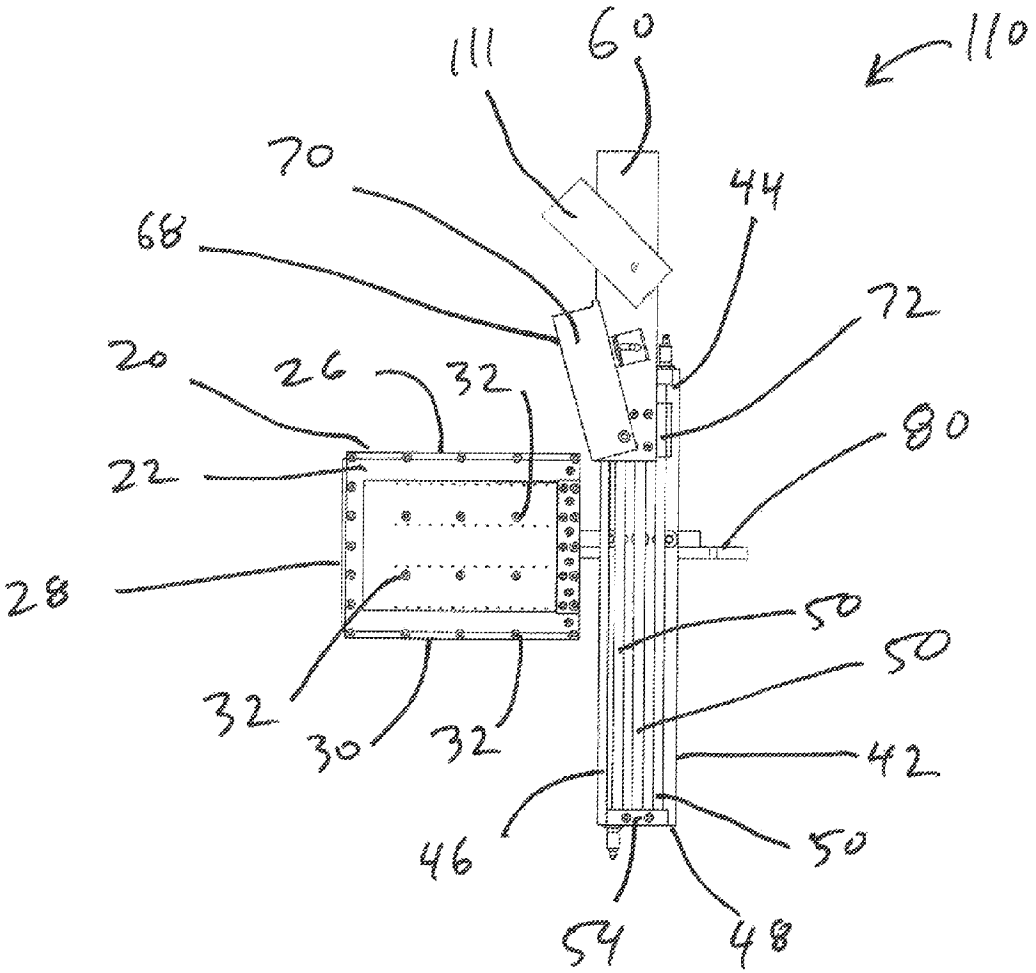
FIG. 20 shows a front view of a label folding apparatus according to at least one embodiment of the present disclosure.
Figure 21:
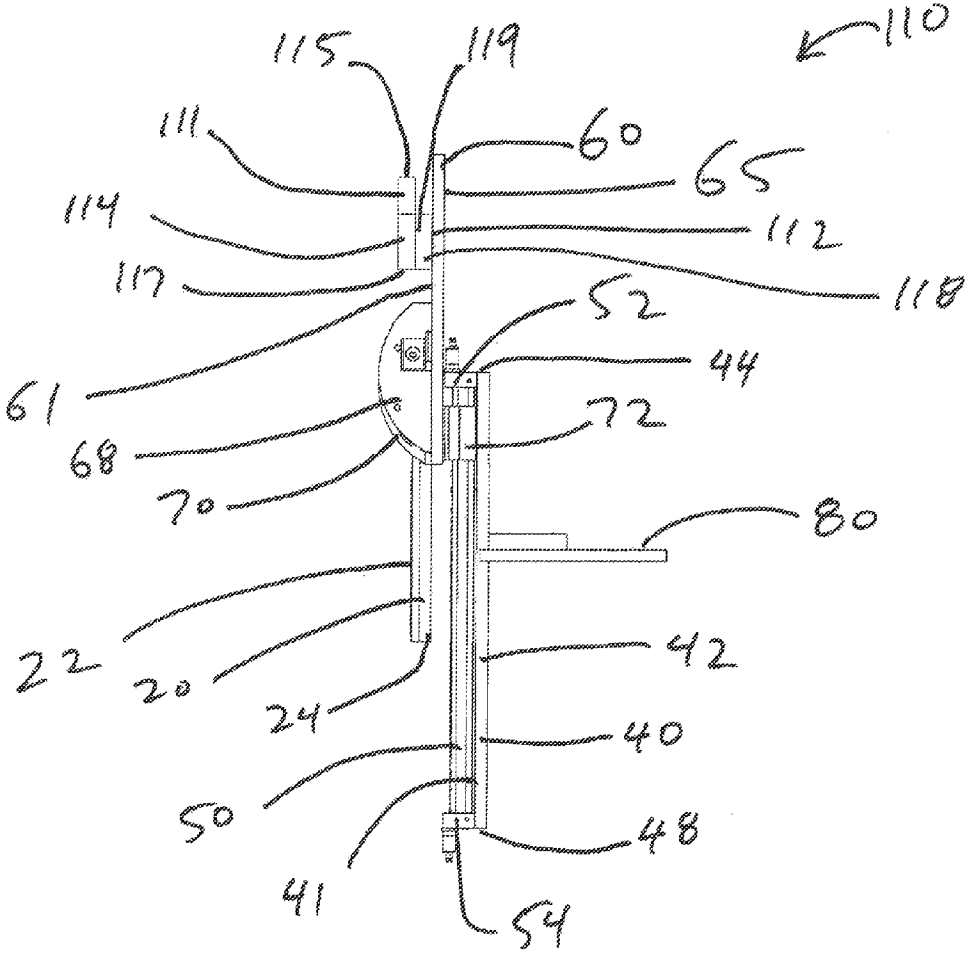
FIG. 21 shows an end view of a label folding apparatus according to at least one embodiment of the present disclosure.

FIG. 19 shows a perspective view of label folding apparatus 110 according to at least one embodiment of the present disclosure. FIG. 20 shows a front view of label folding apparatus 110 according to at least one embodiment of the present disclosure. FIG. 21 shows an end view of label folding apparatus 110 according to at least one embodiment of the present disclosure.

In the embodiment shown in FIGS. 19-21, slide assembly 60 comprises first surface 61 and opposing second surface 65. In at least one embodiment of the present disclosure, a label folding device is affixed to mounting instrument 112. In the embodiment shown in FIGS. 19-21, the label folding device is block 111. Block 111 is affixed to mounting instrument 112, which in turn is affixed to first surface 61. Block 111 comprises first surface 113, first side 114, second side 115, third side 116, and fourth side 117. Although block 111 is shown in FIGS. 19-21 with a rectangular shape, other shapes of block 111 are possible and within the scope of the present disclosure. Additionally, while block 111 is shown in FIGS. 19-21 with straight sides, including first side 114, second side 115, third side 116, and fourth side 117, other configurations of first side 114, second side 115, third side 116, and fourth side 117 are possible and within the scope of the present disclosure. Such other configurations include, for example, curved sides. In the embodiment shown in FIGS. 19-21, block 111 is affixed to first surface 61 of slide assembly 60 such that an axis of block 111 is not in alignment with an axis of guide rails 50. Other configurations of block 111 are possible and within the scope of the present disclosure.

Mounting instrument 112 comprises first side 118, second side 119, third side (not shown), and fourth side 120. While mounting instrument 112 is shown in FIGS. 19-21 with a rectangular shape, other shapes of mounting instrument 112 are possible and within the scope of the present disclosure. Additionally, although mounting instrument 112 is shown in FIGS. 19-21 with straight sides, including first side 118, second side 119, third side (not shown), and fourth side 120, other configurations of first side 118, second side 119, third side (not shown), and fourth side 120 are possible and within the scope of the present disclosure. Such other configurations include, for example, curved sides.

One skilled in the art will understand from the present disclosure that the label folding device and/or mounting instrument 112 may comprise any material and any device capable of folding a label. Such materials may include but are not limited to plastic, rubber, fiber, metal, and combinations thereof. Such devices may include but are not limited to a block, slab, beam, bar, and combinations thereof.

Figure 22:
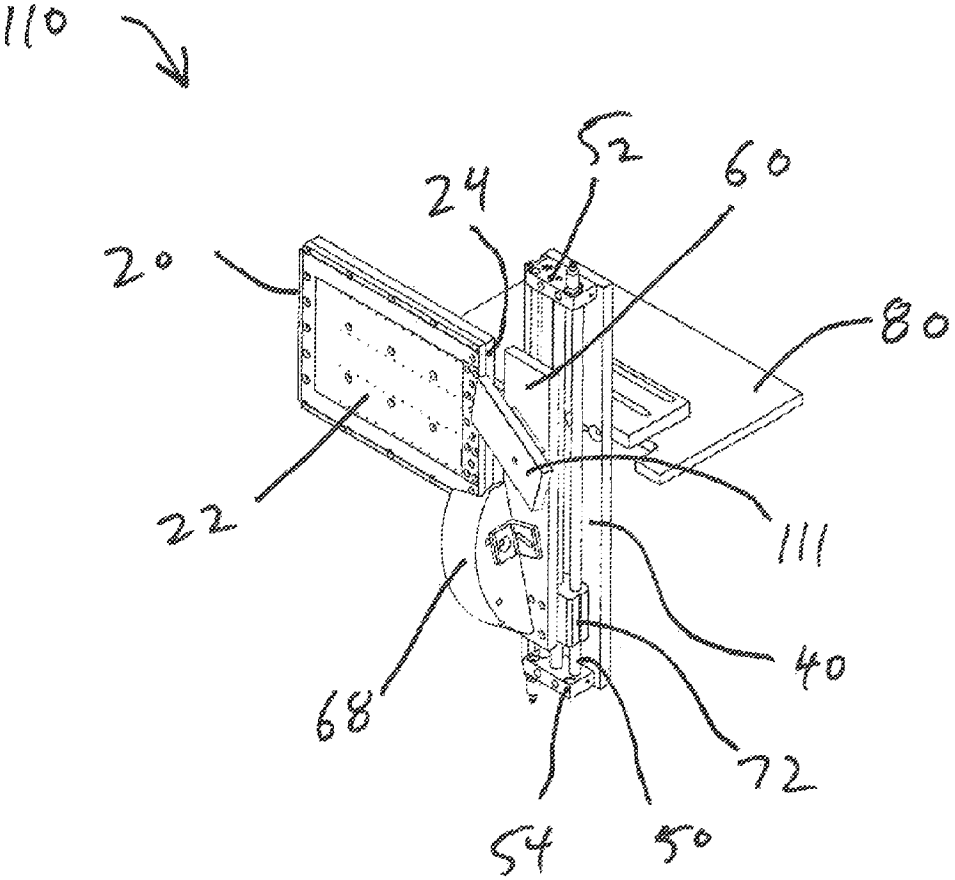
FIG. 22 shows a perspective view of a label folding apparatus according to at least one embodiment of the present disclosure.
Figure 23:
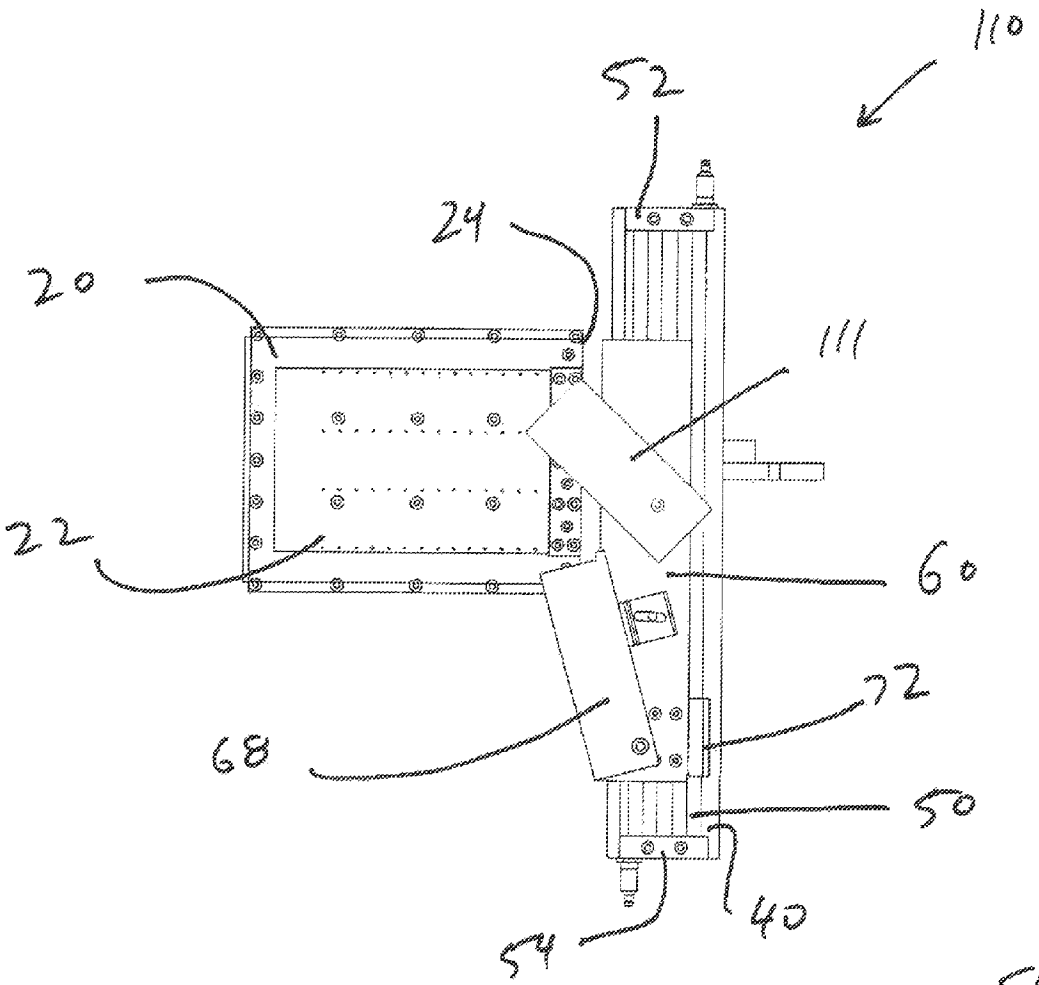
FIG. 23 shows a front view of a label folding apparatus according to at least one embodiment of the present disclosure.
Figure 24:
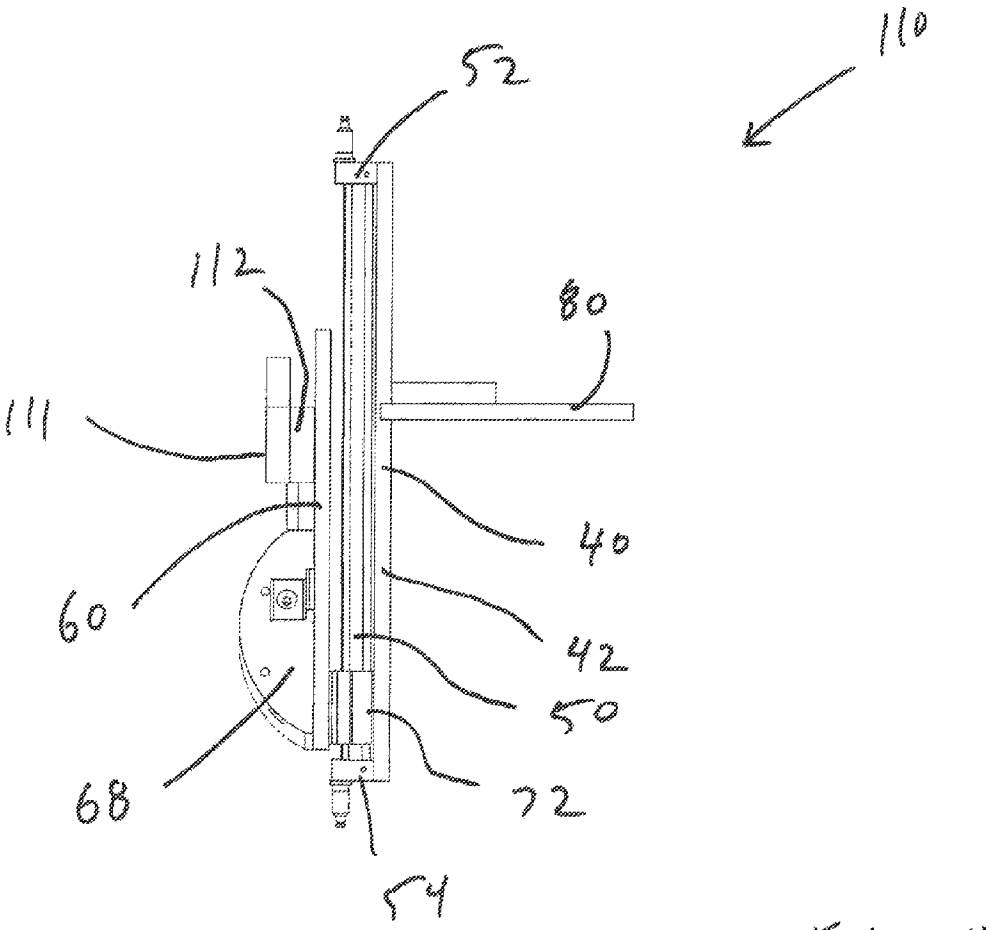
FIG. 24 shows an end view of a label folding apparatus according to at least one embodiment of the present disclosure.

FIGS. 22-24 show label folding apparatus 110 with slide assembly 60 in a second position. In the embodiment shown in FIGS. 22-24, guide 72 is closer to second guide rail mount 54. FIG. 22 shows a perspective view of label folding apparatus 110 according to at least one embodiment of the present disclosure with slide assembly 60 in the second position. FIG. 23 shows a front view of label folding apparatus 110 according to at least one embodiment of the present disclosure with slide assembly 60 in the second position. FIG. 24 shows an end view of label folding apparatus 110 according to at least one embodiment of the present disclosure with slide assembly 60 in the second position. As slide assembly 60 travels along guide rail 50 between the first position shown in FIGS. 19-21 and the second position shown in FIGS. 22-24, label deflector 68 passes by and/or over first end 24 of label pad assembly 22. When slide assembly 60 is in the second position shown in FIGS. 22-24, block 111 is aligned with label pad assembly 20.

Figure 25:
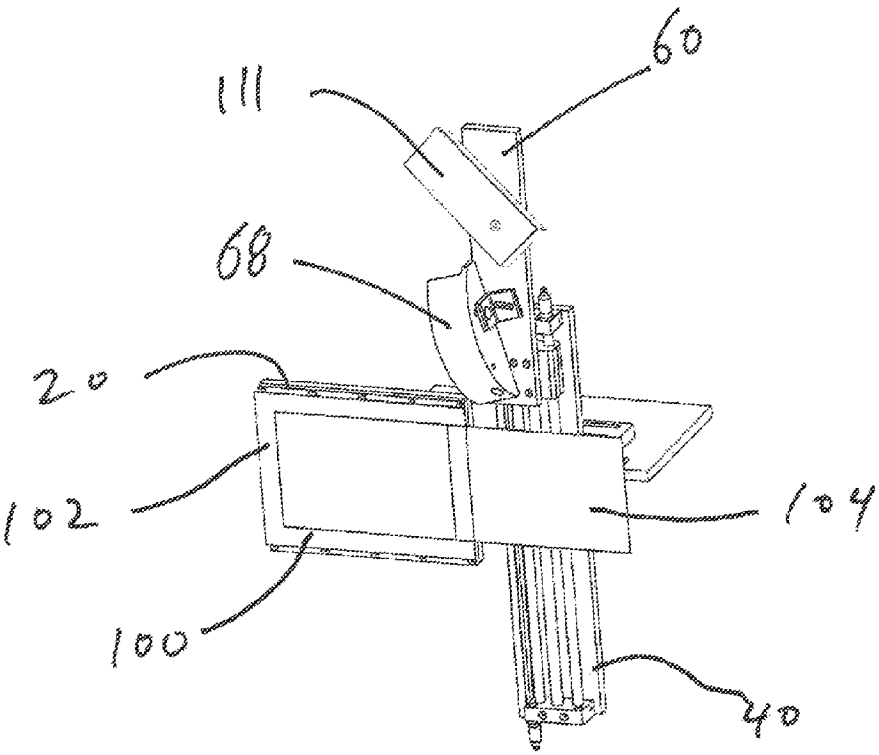
FIG. 25 shows a perspective view of a label folding apparatus according to at least one embodiment of the present disclosure.
Figure 26:
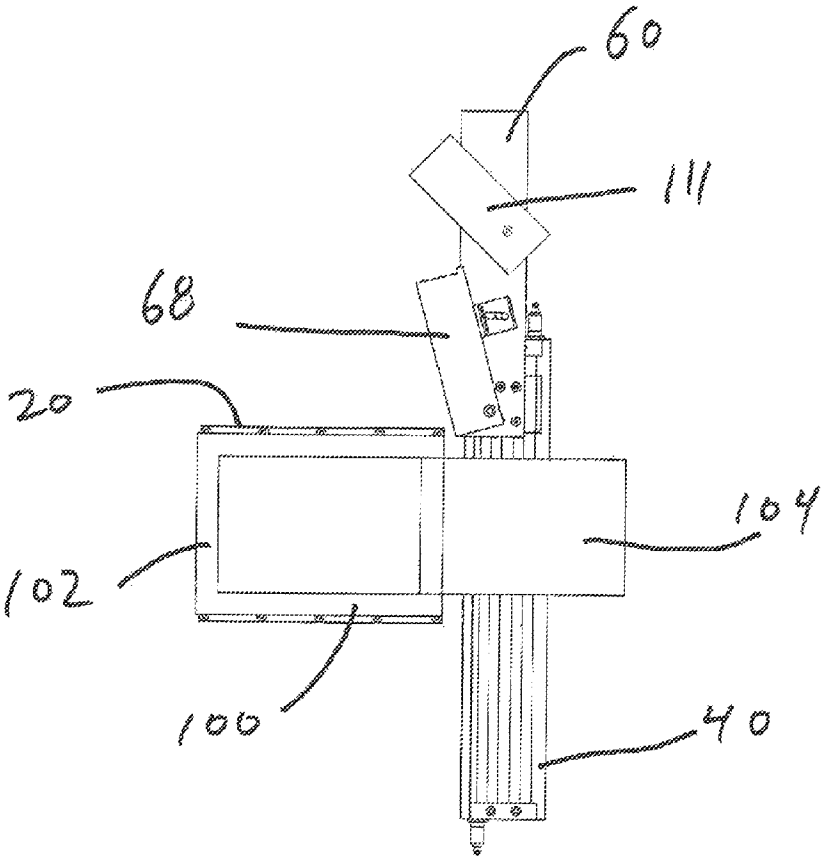
FIG. 26 shows a front view of a label folding apparatus according to at least one embodiment of the present disclosure.

FIG. 25 shows a perspective view of label folding apparatus 110 according to at least one embodiment of the present disclosure with label 100 dispensed thereon. FIG. 26 shows a front view of label folding apparatus 110 according to at least one embodiment of the present disclosure with label 100 dispensed thereon. In the embodiment shown in FIGS. 25 and 26, slide assembly 60 is in the first position as shown in FIGS. 19-21. In the embodiment shown in FIGS. 25 and 26, label 100 comprises covering portion 102 and foldable portion 104. In at least one such embodiment, covering portion 102 comprises a surface area larger than the surface area of foldable portion 104. As shown in FIGS. 25 and 26, at least a portion of covering portion 102 and foldable portion 104 comprise an adhesive backing. Label 100 is dispensed onto label pad assembly 20 so that the adhesive backing of covering portion 102 and foldable portion 104 faces away from label pad surface 22. In the embodiment shown in FIGS. 25 and 26, label 100 is larger than label pad surface 22, so at least a portion of foldable portion 104 extends beyond first end 24 and into the path of label deflector 68. Covering portion 102 is held against label pad surface 22 by a vacuum engaged against covering portion 102 through apertures 32.

Figure 27:
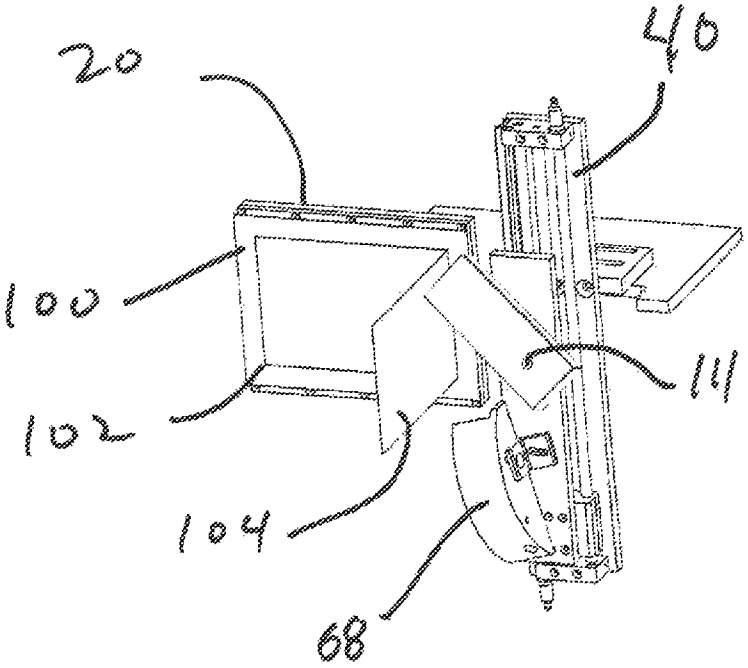
FIG. 27 shows a perspective view of a label folding apparatus according to at least one embodiment of the present disclosure.

FIG. 27 shows label folding apparatus 110 with label 100 dispensed thereon. In the embodiment shown in FIG. 27, slide assembly 60 has traveled from the first position shown in FIGS. 19-21 to the second position shown in FIGS. 22-24. When slide assembly 60 travels from the first position to the second position, label deflector 68 engages foldable portion 104 of label 100, thereby displacing foldable portion 104 of label 100 from its planar alignment with covering portion 102 of label 100. In an embodiment of the present disclosure where label deflector 68 comprises a curved label deflector surface such as curved label deflector surface 70, label deflector 68 progressively engages foldable portion 104 of label 100 as slide assembly 60 travels from the first position to the second position, thereby reducing the risk that label 100 will be torn as label deflector 68 engages foldable portion 104 of label 100.

In an embodiment of the present disclosure where label deflector 68 is affixed to first surface 61 of slide assembly 60 at an angle to an axis of guide rails 50, label deflector 68 progressively engages foldable portion 104 of label 100 as slide assembly 60 travels from the first position to the second position, thereby reducing the risk that label 100 will be torn as label deflector 68 engages foldable portion 104 of label 100. In at least one embodiment of label 100, there may be one or more lines of weakness between covering portion 102 and foldable portion 104 so that displacement of foldable portion 104 by label deflector 68 is facilitated.

In the embodiment shown in FIG. 27 in which slide assembly 60 has traveled from the first position to the second position, block 111 is brought into initial contact with foldable portion 104 of label 100. The initial contact between block 111 and foldable portion 104 of label 100 begins to fold foldable portion 104 of label 100 such that foldable portion 104 on label 100 is angled relative to the covering portion 102 of label 100. A non-limiting example of an angle range that foldable portion 104 on label 100 may be relative to the covering portion 102 of label 100 is from a 90 degree angle to a 1 degree angle. Other angles that foldable portion 104 on label 100 may be relative to the covering portion 102 of label 100 are contemplated and within the scope of the present disclosure.

Figure 28:
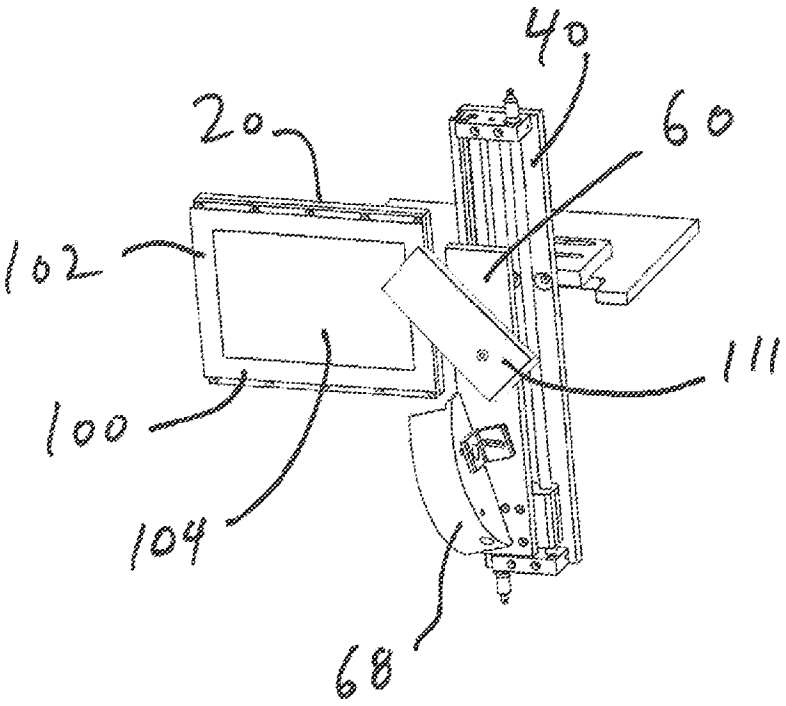
FIG. 28 shows a perspective view of a label folding apparatus according to at least one embodiment of the present disclosure.
Figure 25:
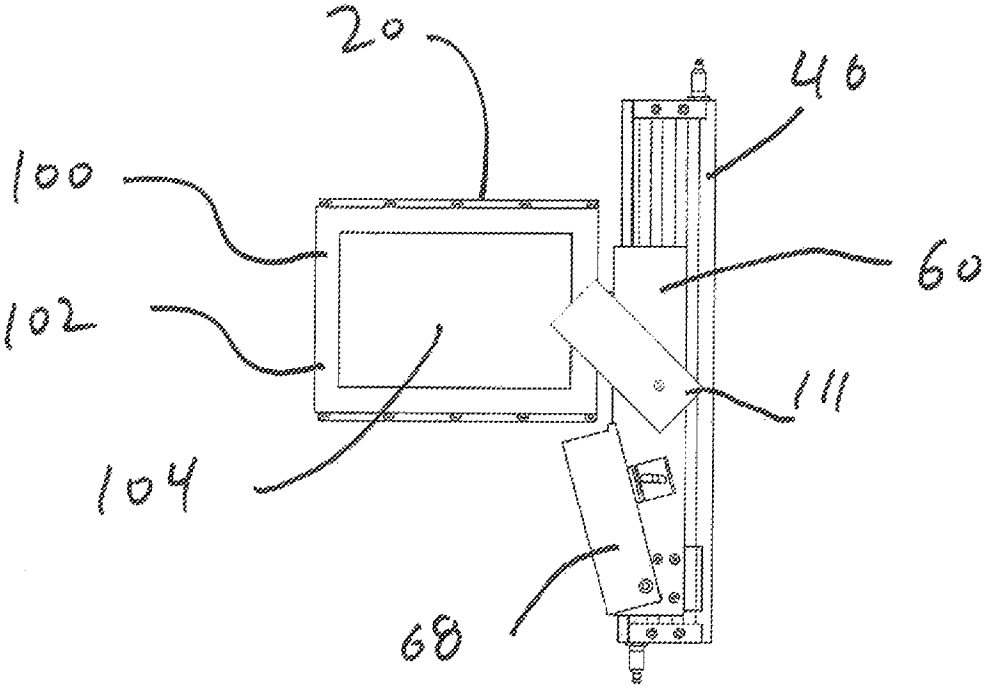

FIG. 28 shows a perspective view of label folding apparatus 110 according to at least one embodiment of the present disclosure with label 100 dispensed thereon. FIG. 29 shows a front view of label folding apparatus 110 according to at least one embodiment of the present disclosure with label 100 dispensed thereon. In the embodiment shown in FIGS. 28 and 29 in which slide assembly 60 has traveled from the first position to the second position, block 111 is brought into complete contact with foldable portion 104 of label 100, folding foldable portion 104 on label 100 against covering portion 102 of label 100. The adhesive backing on a least a part of covering portion 102 of label 100 and/or foldable portion 104 of label 100 causes foldable portion 104 to be adhered against covering portion 102.

Figure 30:
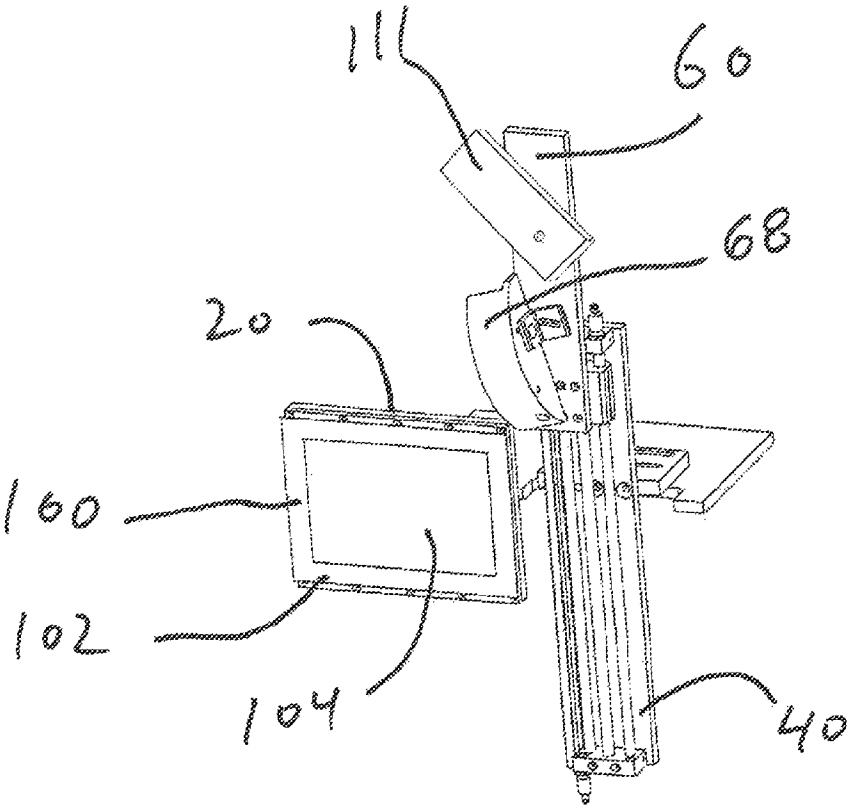
FIG. 30 shows a perspective view of a label folding apparatus according to at least one embodiment of the present disclosure.
Figure 31:
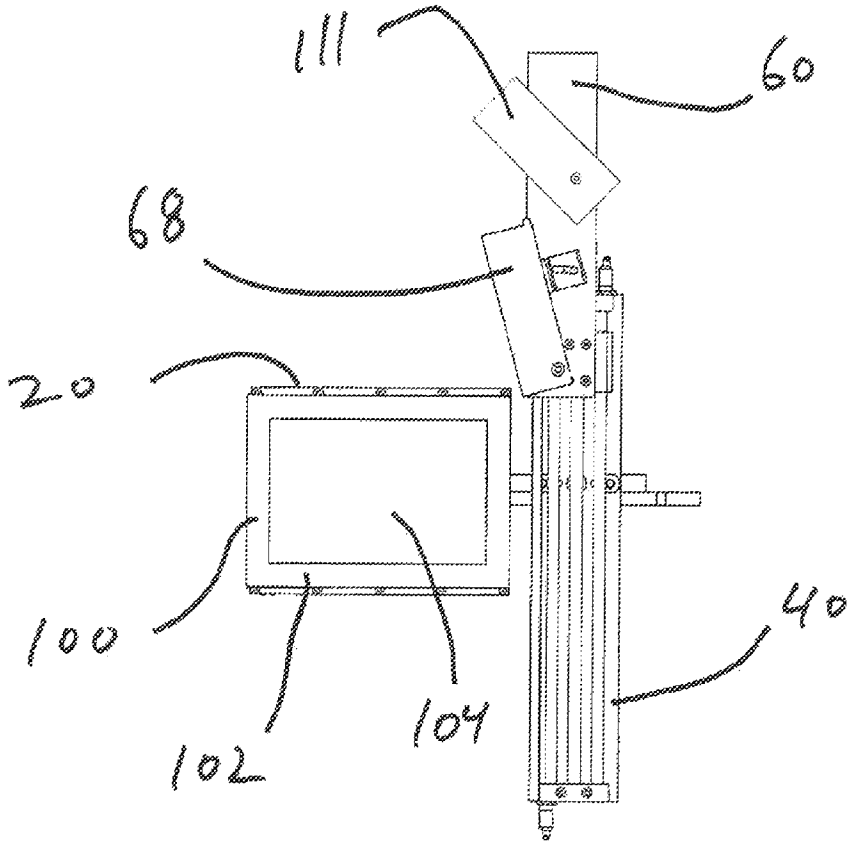
FIG. 31 shows a front view of a label folding apparatus according to at least one embodiment of the present disclosure.

FIG. 30 shows a perspective view of label folding apparatus 110 according to at least one embodiment of the present disclosure with label 100 dispensed thereon. FIG. 31 shows a front view of label folding apparatus 110 according to at least one embodiment of the present disclosure with label 100 dispensed thereon. In the embodiment shown in FIGS. 30 and 31, slide assembly 60 is returned to the first position shown in FIGS. 19-21. In at least one embodiment, label 100 then may be applied to a substrate, such as the surface of a container or the surface of a package. In at least one embodiment, label 100 may be removed from label pad surface 202 manually and manually applied to such a surface. In at least one embodiment, label pad assembly 20 comprises a label applicator mechanism. In such an embodiment, label pad assembly 20 with label 100 attached thereto may be moved into alignment with such a surface so that the exposed adhesive on label 100 will be brought into contact with such a surface.

While this disclosure has been described as having preferred designs, the apparatus and methods according to the present disclosure can be further modified within the scope and spirit of this disclosure. This application is therefore intended to cover any variations, uses, or adaptations of the disclosure using its general principles. For example, any method disclosed herein and in the appended claims represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

We claim:

1. A label folding apparatus comprising:

a label holding assembly, said label holding assembly comprising a first surface suitable for placing a label thereagainst, said label comprising a first portion and second portion; and a label folding assembly adjacent said label holding assembly, said label folding assembly comprising a label deflector and a label folding device attached thereto, said label deflector configured to temporarily engage with and then disengage from said second portion of said label, said label folding device configured to fold said second portion of said label onto said first portion of said label by temporarily engaging with and then disengaging from said second portion of said label after said label deflector has disengaged from said second portion of said label.

2. The label folding apparatus of claim 1, further comprising a moveable carriage to which said label deflector and said label folding device are attached, said moveable carriage being moveable in relation to said label holding assembly.

3. The label folding apparatus of claim 2, wherein said moveable carriage is moveable along a path between a first position and a second position.

4. The label folding apparatus of claim 3, wherein when said label is placed onto said label holding assembly, movement of said moveable carriage to said second position causes said label deflector to temporarily engage with and then disengage from said second portion of said label.

5. The label folding apparatus of claim 4, wherein when said label is placed onto said label holding assembly, movement of said moveable carriage to said second position causes said label folding device to fold said label by temporarily engaging with and then disengaging from said second portion of said label after said label deflector has disengaged from said second portion of said label.

6. The label folding apparatus of claim 1, wherein said label folding device comprises a block.

7. The label folding apparatus of claim 6, wherein said block is affixed to a mounting instrument, and wherein said mounting instrument is affixed to said label folding assembly.

8. The label folding apparatus of claim 6, wherein an axis of said block is not in alignment with an axis of said label folding assembly.

9. The label folding apparatus of claim 2, wherein said moveable carriage is moveable in a perpendicular direction in relation to said label holding assembly.

10. The label folding apparatus of claim 9, said moveable carriage configured to intersect the axis of said label holding device and said label deflector configured to temporarily engage with and then disengage from said second portion of said label.

11. The label folding apparatus of claim 10, said moveable carriage configured to continue moving after said label deflector has disengaged from said second portion of said label and said label folding device configured to fold said second portion of said label onto said first portion of said label by temporarily engaging with and then disengaging from said second portion of said label.

12. The label folding apparatus of claim 2, wherein said label deflector and said label folding device remain stationary in relation to said moveable carriage.

13. The label folding apparatus of claim 1, wherein said label deflector and said label folding device comprise a single mechanism.

14. The label folding apparatus of claim 2, wherein said second portion of said label extends into a path of travel of said moveable carriage.

15. The label folding apparatus of claim 3, wherein said second portion of said label is in said path, and wherein when said moveable carriage moves along said path, said label deflector is brought into temporary contact with said label and said label folding device folds said label by being brought into temporary contact with said label.

16. The label folding apparatus of claim 1, further comprising:

a moveable carriage to which said label deflector and said label folding device are attached, said moveable carriage being moveable between a first position and a second position, and wherein when said label is placed onto said label holding assembly, movement of said moveable carriage between said first position and said second position causes said label deflector to engage with and then disengage from said second portion of said label and said label folding device to fold said second portion of said label onto said first portion of said label by temporarily engaging with and then disengaging from said second portion of said label after said label deflector has disengaged from said second portion of said label.

17. A label folding apparatus comprising:

a label folding assembly, said label folding assembly comprising a moveable carriage with a label folding device attached thereto, said label folding device comprising a block, wherein said block is not in alignment with an axis of said label folding assembly; and a label holding assembly adjacent said label folding assembly, said label holding assembly comprising a first flat surface suitable for placing a label thereagainst, wherein said moveable carriage is moveable in relation to said label holding assembly while said label folding device remains stationary in relation to said moveable carriage.

18. The label folding apparatus of claim 17, wherein when said label is placed onto said label holding assembly, movement of said moveable carriage causes said label folding device to fold said label by temporarily engaging with and then disengaging from said second portion of said label.

19. The label folding apparatus of claim 17, wherein said moveable carriage is moveable in a perpendicular direction in relation to said label holding assembly.

20. The label folding apparatus of claim 19, said moveable carriage configured to intersect the axis of said label holding device.

21. The label folding apparatus of claim 20, said label folding device configured to fold said second portion of said label onto said first portion of said label by temporarily engaging with and then disengaging from said second portion of said label.

22. The label folding apparatus of claim 1, wherein said label holding assembly further comprises at least one aperture through said first surface.

23. The label folding apparatus of claim 22, wherein when said label is placed onto said label holding assembly, said label is held against said label holding assembly by a vacuum force acting through said at least one aperture.

24. The label folding apparatus of claim 1, wherein said first surface comprises at least one boundary adjacent said label holding assembly, and wherein when said label is placed onto said label holding assembly, said second portion of said label extends past said boundary.

* * * * *